US009978221B2

(12) United States Patent
Friedman et al.

(10) Patent No.: US 9,978,221 B2
(45) Date of Patent: May 22, 2018

(54) GAMING SYSTEM AND METHOD FOR PROVIDING A MULTIPLE DIMENSION SYMBOL GAME WITH EXPANDING WILD SYMBOLS

(71) Applicant: IGT, Las Vegas, NV (US)

(72) Inventors: Stacy A. Friedman, Beaverton, OR (US); Cooper Dubois, Normandy Park, WA (US)

(73) Assignee: IGT, Las Vegas, NV (US)

( * ) Notice: Subject to any disclaimer, the term of this patent is extended or adjusted under 35 U.S.C. 154(b) by 270 days.

(21) Appl. No.: 14/215,858

(22) Filed: Mar. 17, 2014

(65) Prior Publication Data

US 2014/0287812 A1 Sep. 25, 2014

Related U.S. Application Data

(60) Provisional application No. 61/804,486, filed on Mar. 22, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3265* (2013.01)

(58) Field of Classification Search
CPC ... G07F 17/34; G07F 17/3213; G07F 17/3265
See application file for complete search history.

(56) References Cited

U.S. PATENT DOCUMENTS

| | | | |
|---|---|---|---|
| 1,978,395 | A | 10/1934 | Groetchen |
| 3,420,525 | A | 1/1969 | Waders |
| 3,642,287 | A | 2/1972 | Lally et al. |
| 3,735,987 | A | 5/1973 | Ohki |
| 4,099,722 | A | 7/1978 | Rodesch et al. |
| 4,198,052 | A | 4/1980 | Gauselmann |
| 4,200,291 | A | 4/1980 | Hooker |
| 4,326,351 | A | 4/1982 | Heywood et al. |
| 4,357,567 | A | 11/1982 | Rock |
| 4,636,951 | A | 1/1987 | Harlick |
| 4,695,053 | A | 9/1987 | Vazquez, Jr. et al. |
| 4,711,451 | A | 12/1987 | Pajak et al. |
| 4,722,527 | A | 2/1988 | Gauselmann |
| 4,790,537 | A | 12/1988 | Smyth et al. |
| 4,826,169 | A | 5/1989 | Bessho et al. |
| 4,874,173 | A | 10/1989 | Kishishita |
| 5,092,598 | A | 3/1992 | Kamille |
| 5,152,529 | A | 10/1992 | Okada |
| 5,205,555 | A | 4/1993 | Hamano |
| RE34,244 | E | 5/1993 | Hagiwara |
| 5,224,706 | A | 7/1993 | Bridgeman et al. |
| 5,308,062 | A | 5/1994 | Hogan |

(Continued)

FOREIGN PATENT DOCUMENTS

| | | |
|---|---|---|
| AU | 198774936 | 6/1987 |
| AU | 710015 | 9/1997 |

(Continued)

*Primary Examiner* — James S McClellan
*Assistant Examiner* — Kevin Carter
(74) *Attorney, Agent, or Firm* — Neal, Gerber & Eisenberg LLP

(57) ABSTRACT

Gaming systems and methods for providing a multi-dimensional symbol game with expanding wild symbols.

34 Claims, 22 Drawing Sheets

(56) References Cited

U.S. PATENT DOCUMENTS 5,308,065 A 5/1994 Bridgeman et al.
5,332,219 A 7/1994 Marnell, II et al.
5,332,228 A 7/1994 Schultz
5,364,100 A 11/1994 Ludlow et al.
5,393,057 A 2/1995 Marnell, II
5,395,111 A 3/1995 Inoue
5,423,539 A 6/1995 Nagao
5,431,408 A 7/1995 Adams
5,449,173 A 9/1995 Thomas et al.
5,531,440 A 7/1996 Dabrowski et al.
5,564,700 A 10/1996 Celona
5,584,764 A 12/1996 Inoue
5,609,524 A 3/1997 Inoue
5,624,119 A 4/1997 Leake
5,664,998 A 9/1997 Seelig et al.
5,704,835 A 1/1998 Dietz
5,720,662 A 2/1998 Holmes et al.
5,722,891 A 3/1998 Inoue
5,752,881 A 5/1998 Inoue
5,769,716 A 6/1998 Saffari et al.
5,772,506 A 6/1998 Marks et al.
5,807,172 A 9/1998 Piechowiak
5,813,911 A 9/1998 Margolin
5,823,873 A 10/1998 Moody
5,833,536 A 11/1998 Davids et al.
5,833,537 A 11/1998 Barrie
5,863,249 A 1/1999 Inoue
5,882,260 A 3/1999 Marks et al.
5,951,397 A 9/1999 Dickinson
5,980,384 A 11/1999 Barrie
5,984,782 A 11/1999 Inoue
5,997,400 A 12/1999 Seelig et al.
5,997,401 A 12/1999 Crawford
6,033,307 A 3/2000 Vancura
6,056,642 A 5/2000 Bennett
6,059,289 A 5/2000 Vancura
6,059,658 A 5/2000 Mangano et al.
6,062,978 A 5/2000 Martino et al.
6,086,066 A 7/2000 Tekeuchi et al.
6,089,976 A 7/2000 Schneider et al.
6,089,977 A 7/2000 Bennett
6,093,102 A 7/2000 Bennett
6,095,921 A 8/2000 Walker et al.
6,117,013 A 9/2000 Eiba
6,120,031 A 9/2000 Adams
6,120,376 A 9/2000 Bennett
6,120,377 A 9/2000 McGinnis et al.
6,139,124 A 10/2000 Baerlocher et al.
6,142,872 A 11/2000 Walker et al.
6,142,875 A 11/2000 Kodachi et al.
6,149,521 A 11/2000 Sanduski
6,159,095 A 12/2000 Frohm et al.
6,159,096 A 12/2000 Yoseloff
6,159,098 A 12/2000 Slomiany et al.
6,174,235 B1 1/2001 Walker et al.
6,190,254 B1 2/2001 Bennett
6,203,009 B1 3/2001 Sines et al.
6,220,959 B1 4/2001 Holmes, Jr. et al.
6,224,484 B1 5/2001 Okuda et al.
6,227,971 B1 5/2001 Weiss
6,241,607 B1 6/2001 Payne et al.
6,251,013 B1 6/2001 Bennett
6,254,481 B1 7/2001 Jaffe
6,261,177 B1 7/2001 Bennett
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,429 B1 10/2001 Friedrich
6,305,686 B1 10/2001 Perrie et al.
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,318,721 B1 11/2001 Randall et al.
6,319,124 B1 11/2001 Baerlocher et al.
6,322,078 B1 11/2001 Adams
6,332,838 B1 12/2001 Yamagami
6,334,814 B1 1/2002 Adams
6,336,860 B1 1/2002 Webb
6,346,043 B1 2/2002 Colin et al.
6,347,996 B1 2/2002 Gilmore et al.
6,358,144 B1 3/2002 Kaddlic et al.
6,375,570 B1 4/2002 Poole
6,394,902 B1 5/2002 Glavich et al.
6,398,644 B1 6/2002 Perrie et al.
6,409,602 B1 6/2002 Wilshire et al.
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,439,993 B1 8/2002 O'Halloran
6,454,266 B1 9/2002 Breeding et al.
6,458,032 B1 10/2002 Yamagami
6,464,581 B1 10/2002 Yoseloff et al.
6,481,713 B2 11/2002 Perrie et al.
6,494,454 B2 12/2002 Adams
6,517,432 B1 2/2003 Jaffe
6,517,433 B2 2/2003 Loose et al.
6,554,703 B1 4/2003 Bussick et al.
6,554,704 B2 4/2003 Nicastro et al.
6,561,904 B2 5/2003 Locke et al.
6,565,433 B1 5/2003 Baerlocher et al.
6,575,830 B2 6/2003 Baerlocher et al.
6,585,591 B1 7/2003 Baerlocher et al.
6,589,114 B2 7/2003 Rose
6,604,740 B1 8/2003 Singer et al.
6,616,142 B2 9/2003 Adams
6,632,139 B1 10/2003 Baerlocher
6,632,140 B2 10/2003 Berman et al.
6,634,945 B2 10/2003 Glavich et al.
6,641,477 B1 11/2003 Dietz
6,643,943 B2 11/2003 Dall'Aglio et al.
6,644,663 B2 11/2003 Seelig et al.
6,644,664 B2 11/2003 Muir et al.
6,645,070 B2 11/2003 Lupo
6,659,864 B2 12/2003 McGahn et al.
6,666,767 B1 12/2003 Dayan
6,676,511 B2 1/2004 Payne et al.
6,676,512 B2 1/2004 Fong et al.
6,695,696 B1 2/2004 Kaminkow
6,702,671 B2 3/2004 Tarantino
6,712,693 B1 3/2004 Hettinger
6,715,756 B2 4/2004 Inoue
6,719,630 B1 4/2004 Seelig et al.
6,733,386 B2 5/2004 Cuddy et al.
6,746,328 B2 6/2004 Cannon et al.
6,746,329 B1 6/2004 Duhamel
6,749,502 B2 6/2004 Baerlocher
6,780,109 B2 8/2004 Kaminkow
6,786,818 B1 9/2004 Rothschild et al.
6,802,775 B2 10/2004 Baerlocher et al.
6,805,349 B2 10/2004 Baerlocher et al.
6,805,632 B2 10/2004 Suda
6,808,454 B2 10/2004 Gerrard et al.
6,832,957 B2 12/2004 Falconer
6,835,133 B2 12/2004 Baerlocher et al.
6,837,788 B2 1/2005 Cannon
6,855,054 B2 2/2005 White et al.
6,866,583 B2 3/2005 Glavich et al.
6,875,106 B2 4/2005 Weiss et al.
6,878,061 B2 4/2005 Baerlocher et al.
6,887,157 B2 5/2005 LeMay et al.
6,896,617 B2 5/2005 Daly
6,905,406 B2 6/2005 Kaminkow et al.
6,908,381 B2 6/2005 Ellis
6,910,962 B2 6/2005 Marks et al.
6,913,533 B2 7/2005 Cuddy et al.
6,921,335 B2 7/2005 Rodgers et al.
6,929,952 B2 8/2005 Baerlocher
6,935,950 B2 8/2005 Tarantino

(56) References Cited

U.S. PATENT DOCUMENTS 6,939,229 B2 9/2005 McClintic
6,942,571 B1 9/2005 McAllister et al.
6,960,133 B1 11/2005 Marks et al.
6,960,134 B2 11/2005 Hard et al.
6,964,416 B2 11/2005 McClintic et al.
6,971,955 B2 12/2005 Baerlocher et al.
6,979,263 B2 12/2005 Baerlocher et al.
6,981,635 B1 1/2006 Hughs-Baird et al.
6,986,710 B2 1/2006 Baerlocher et al.
6,991,538 B2 1/2006 Cannon
6,997,804 B2 2/2006 Berman
7,001,274 B2 2/2006 Baerlocher et al.
7,014,560 B2 3/2006 Glavich et al.
7,022,016 B2 4/2006 Wood et al.
7,040,983 B2 5/2006 Dolloff et al.
7,048,275 B2 5/2006 Adams
7,052,395 B2 5/2006 Glavich et al.
7,056,209 B2 6/2006 Baerlocher et al.
7,056,213 B2 6/2006 Ching et al.
7,059,967 B2 6/2006 Baerlocher
7,070,502 B1 7/2006 Bussick et al.
7,074,127 B2 7/2006 Cuddy et al.
7,077,745 B2 7/2006 Gomez et al.
7,090,580 B2 8/2006 Rodgers et al.
7,094,148 B2 8/2006 Baerlocher et al.
7,104,886 B2 9/2006 Baerlocher et al.
7,108,602 B2 9/2006 Daly
7,128,646 B2 10/2006 Baerlocher et al.
7,137,888 B2 11/2006 Glavich et al.
7,144,322 B2 12/2006 Gomez et al.
7,153,205 B2 12/2006 Baerlocher
7,160,186 B2 1/2007 Cuddy et al.
7,169,042 B2 1/2007 Muir et al.
7,192,345 B2 3/2007 Muir et al.
7,195,559 B2 3/2007 Gilmore et al.
7,222,858 B2 5/2007 Moody
7,226,359 B2 6/2007 Bussick et al.
7,236,113 B1 6/2007 Wang
7,252,591 B2 8/2007 Van Asdale
7,252,592 B2 8/2007 Rodgers et al.
7,294,055 B2 11/2007 Baerlocher et al.
7,294,058 B1 11/2007 Slomiany et al.
7,309,281 B2 12/2007 Baerlocher et al.
7,309,282 B2 12/2007 Baerlocher et al.
7,331,862 B2 2/2008 Rodgers et al.
7,331,866 B2 2/2008 Rodgers et al.
7,341,512 B2 3/2008 Dolloff et al.
7,357,713 B2 4/2008 Marks et al.
7,371,169 B2 5/2008 Baerlocher
7,371,170 B2 5/2008 Cregan et al.
7,371,172 B2 5/2008 Inoue
7,396,279 B2 7/2008 Berman et al.
7,399,225 B2 7/2008 Kaminkow
7,399,226 B2 7/2008 Mishra
7,402,102 B2 7/2008 Marks et al.
7,442,123 B2 10/2008 Brill et al.
7,448,948 B2 11/2008 Hughs-Baird et al.
7,473,173 B2 1/2009 Peterson et al.
7,494,412 B2 2/2009 Baerlocher
7,510,473 B2 3/2009 Thomas
7,513,826 B2 4/2009 Cuddy
7,553,231 B2 6/2009 Rodgers et al.
7,591,723 B2 9/2009 Cregan et al.
7,604,539 B2 10/2009 Hartl et al.
7,611,406 B2 11/2009 Fuller
7,666,085 B2 2/2010 Vorias et al.
7,690,983 B2 4/2010 Hartl et al.
7,749,063 B2 7/2010 Belger et al.
7,749,082 B2 7/2010 Dunaevsky et al.
7,753,773 B2 7/2010 Baerlocher et al.
7,785,179 B2 8/2010 Ionescu
7,914,376 B2 3/2011 Walker et al.
7,950,994 B2 5/2011 Berman et al.
7,951,722 B2 5/2011 Ho
8,002,625 B2 8/2011 Maya
8,043,155 B2 10/2011 Singer et al.
8,105,151 B2 1/2012 Caputo et al.
8,137,179 B2 3/2012 Jensen et al.
8,162,741 B2 4/2012 Wadleigh et al.
8,192,275 B2 6/2012 Aoki et al.
8,221,206 B2 7/2012 Marks et al.
8,227,307 B2 7/2012 Chen et al.
8,287,357 B2 10/2012 Evans
8,323,091 B2 12/2012 Frank et al.
8,366,538 B1 2/2013 Saunders et al.
8,371,930 B1 2/2013 Saunders et al.
8,414,380 B2 4/2013 Saunders et al.
8,444,473 B2 5/2013 Ching et al.
8,512,138 B2 8/2013 Saunders
2001/0016513 A1 8/2001 Muir et al.
2002/0010017 A1 1/2002 Bennett
2002/0025849 A1 2/2002 Olive
2002/0068623 A1 6/2002 Gauselmann
2002/0077165 A1 6/2002 Bansemer et al.
2003/0045345 A1 3/2003 Berman
2003/0045354 A1 3/2003 Giobbi
2003/0054874 A1 3/2003 Kaminkow
2003/0057645 A1 3/2003 Baerlocher et al.
2003/0060267 A1 3/2003 Glavich et al.
2003/0064768 A1 4/2003 Fier
2003/0100356 A1 5/2003 Brown et al.
2003/0157981 A1 8/2003 Marks et al.
2003/0190945 A1 10/2003 Bussick et al.
2003/0203753 A1 10/2003 Muir et al.
2003/0207710 A1 11/2003 Rodgers et al.
2004/0012145 A1 1/2004 Inoue
2004/0014516 A1 1/2004 Inoue
2004/0014517 A1 1/2004 Inoue
2004/0018866 A1 1/2004 Inoue
2004/0023714 A1 2/2004 Asdale
2004/0026854 A1 2/2004 Inoue
2004/0033827 A1 2/2004 Gilmore et al.
2004/0033829 A1 2/2004 Pacey et al.
2004/0036218 A1 2/2004 Inoue
2004/0038726 A1 2/2004 Inoue
2004/0043809 A1 3/2004 Gomez et al.
2004/0048651 A1 3/2004 Vorias et al.
2004/0053669 A1 3/2004 Gerrard et al.
2004/0053672 A1 3/2004 Baerlocher
2004/0053676 A1 3/2004 Rodgers
2004/0067790 A1 4/2004 Peterson et al.
2004/0072612 A1 4/2004 Rodgers et al.
2004/0097280 A1 5/2004 Gauselmann
2004/0102236 A1 5/2004 Suda et al.
2004/0102244 A1 5/2004 Kryuchkov et al.
2004/0102245 A1 5/2004 Escalera et al.
2004/0137982 A1 7/2004 Cuddy et al.
2004/0147306 A1 7/2004 Randall et al.
2005/0020344 A1 1/2005 Kaminkow
2005/0049035 A1 3/2005 Baerlocher et al.
2005/0054418 A1 3/2005 Baerlocher
2005/0054429 A1 3/2005 Baerlocher et al.
2005/0059446 A1 3/2005 Kaminkow
2005/0059478 A1 3/2005 Peterson et al.
2005/0064924 A1 3/2005 Glavich et al.
2005/0070354 A1 3/2005 Baerlocher et al.
2005/0101380 A1 5/2005 Glavich et al.
2005/0119403 A1 6/2005 St. Clair
2005/0148381 A1 7/2005 Marks et al.
2005/0148384 A1 7/2005 Marks et al.
2005/0227754 A1 10/2005 Kaminkow et al.
2005/0245307 A1 11/2005 Gatto et al.
2005/0282620 A1 12/2005 Marks et al.
2005/0288094 A1 12/2005 Marks et al.
2006/0030392 A1 2/2006 Rodgers et al.
2006/0046830 A1 3/2006 Webb
2006/0058097 A1 3/2006 Berman et al.
2006/0068875 A1 3/2006 Cregan et al.
2006/0068882 A1 3/2006 Baerlocher et al.
2006/0068884 A1 3/2006 Baerlocher et al.
2006/0068885 A1 3/2006 Cregan et al.
2006/0073876 A1 4/2006 Cuddy
2006/0073879 A1 4/2006 Baerlocher
2006/0084492 A1 4/2006 Baerlocher et al.

(56) References Cited

U.S. PATENT DOCUMENTS

2006/0084494 A1 4/2006 Belger et al.
2006/0084498 A1 4/2006 Baerlocher et al.
2006/0089191 A1 4/2006 Singer et al.
2006/0116195 A1 6/2006 Baerlocher et al.
2006/0172795 A1 8/2006 Bussick et al.
2006/0199636 A1 9/2006 Ching et al.
2006/0199637 A1 9/2006 Ching et al.
2006/0217189 A1 9/2006 Walker et al.
2006/0258423 A1 11/2006 Englman et al.
2006/0264254 A1 11/2006 Aoki
2007/0010316 A1 1/2007 Baerlocher et al.
2007/0021176 A1 1/2007 Jackson
2007/0021188 A1 1/2007 Rodgers et al.
2007/0060246 A1 3/2007 Baerlocher et al.
2007/0060248 A1 3/2007 Rodgers et al.
2007/0060294 A1 3/2007 Cuddy et al.
2007/0087812 A1 4/2007 Glavich et al.
2007/0287523 A1 12/2007 Esses et al.
2008/0051174 A1 2/2008 Fiden
2008/0090655 A1 4/2008 Marks et al.
2008/0096670 A1 4/2008 Baerlocher et al.
2008/0102931 A1 5/2008 Marks et al.
2008/0108411 A1 5/2008 Jensen et al.
2008/0113735 A1* 5/2008 Maya ..... G07F 17/32 463/20
2008/0113765 A1 5/2008 DeWall
2008/0132320 A1 6/2008 Rodgers
2008/0139298 A1 6/2008 Rodgers et al.
2008/0200232 A1 8/2008 Baerlocher et al.
2008/0200238 A1 8/2008 Mishra
2008/0214282 A1 9/2008 Inoue
2008/0234032 A1 9/2008 Brunet de Coursson et al.
2009/0118004 A1 5/2009 Hoffman
2009/0124325 A1 5/2009 Wadleigh et al.
2009/0124347 A1 5/2009 Rodgers et al.
2009/0264179 A1* 10/2009 McKay ..... G07F 17/3202 463/20
2010/0004050 A1 1/2010 Caputo et al.
2010/0004056 A1 1/2010 Walker et al.
2010/0022297 A1 1/2010 Saunders
2010/0029364 A1 2/2010 Zielinski
2010/0120507 A1 5/2010 Rodgers et al.
2010/0124972 A1 5/2010 Rodgers et al.
2010/0130280 A1 5/2010 Arezina et al.
2010/0234089 A1 9/2010 Saffari et al.
2010/0298041 A1* 11/2010 Berman ..... G07F 17/3265 463/20
2011/0045906 A1* 2/2011 Berman ..... G07F 17/3202 463/32
2011/0053675 A1 3/2011 Aoki et al.
2011/0086695 A1 4/2011 Evans
2011/0111825 A1 5/2011 Caputo
2011/0117989 A1 5/2011 Kennedy et al.
2012/0108317 A1 5/2012 Caputo et al.
2012/0115578 A1 5/2012 Caputo et al.
2012/0115606 A1 5/2012 Seelig
2012/0238348 A1 9/2012 Aoki et al.
2013/0023325 A1 1/2013 Saunders et al.
2013/0023326 A1 1/2013 Saunders et al.
2013/0023327 A1* 1/2013 Saunders ..... G07F 17/326 463/20
2013/0023329 A1* 1/2013 Saunders ..... G07F 17/326 463/20
2013/0150142 A1 6/2013 Caputo
2013/0190066 A1 7/2013 Saunders
2013/0190067 A1 7/2013 Saunders
2013/0143635 A1 12/2013 Arora et al.
2013/0344939 A1* 12/2013 Aoki ..... G07F 17/326 463/21

FOREIGN PATENT DOCUMENTS

AU 722969 6/1998
AU 199917318 9/1999
AU 200069612 2/2001
AU 200139027 10/2001
AU 2001256012 12/2001
AU 2001256014 12/2001
EP 0058488 8/1982
EP 0060019 9/1982
EP 0410789 1/1991
EP 0874337 10/1998
EP 0981119 2/2000
EP 0984408 3/2000
EP 1039424 9/2000
EP 1063622 12/2000
EP 1150261 10/2001
EP 1184822 3/2002
EP 1197932 4/2002
EP 1205894 5/2002
EP 1422673 5/2004
EP 1513117 3/2005
GB 1454046 10/1976
GB 2062922 5/1981
GB 2106293 9/1981
GB 2081952 2/1982
GB 2090690 7/1982
GB 2096376 10/1982
GB 2097160 10/1982
GB 2100905 1/1983
GB 2105891 3/1983
GB 2106295 4/1983
GB 2113881 8/1983
GB 2117155 10/1983
GB 2137392 10/1984
GB 2161008 1/1986
GB 2165385 4/1986
GB 2170643 8/1986
GB 2180087 3/1987
GB 2181589 4/1987
GB 2183882 6/1987
GB 2191030 12/1987
GB 2222712 3/1990
GB 2225889 6/1990
GB 2226436 6/1990
GB 2242300 9/1991
GB 2262642 6/1993
GB 2322217 8/1998
GB 2335524 9/1999
GB 2372132 2/2001
GB 2393555 3/2004
WO WO9732285 9/1997
WO WO9820949 5/1998
WO WO0030727 6/2000
WO WO0032286 6/2000
WO WO0066235 11/2000
WO WO0076606 12/2000
WO WO0126019 4/2001
WO WO03026756 4/2003
WO WO04025584 3/2004
WO WO05028043 3/2005
WO WO06076294 7/2006
WO WO07002935 1/2007
WO WO07084766 7/2007
WO WO07130443 11/2007
WO WO07130444 11/2007

* cited by examiner

GAMING SYSTEM AND METHOD FOR PROVIDING A MULTIPLE DIMENSION SYMBOL GAME WITH EXPANDING WILD SYMBOLS

PRIORITY CLAIM

This application claims priority to and the benefit of U.S. Provisional Patent Application Ser. No. 61/804,486, filed on Mar. 22, 2013, the entire contents of which are incorporated by reference herein.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards.

Certain known gaming machines include a plurality of reels. Each reel includes a plurality of symbols. After a player places a wager on the game, the reels spin and then stop to display a generated combination of symbols on the reels. If a winning symbol or winning combination of symbols is/are generated along an active payline associated with the reels (or in a scatter pay configuration), the player receives the award associated with the generated winning symbol or generated winning combination of symbols. Certain players become frustrated if they "almost win an award" when the symbols necessary for a winning combination substantially appear on the reels but are missing a symbol or are not in the proper configuration or order to produce a winning symbol combination.

One popular game feature which attempts to resolve such frustration in these situations and increase the player's award opportunities is a wild symbol. A wild symbol changes, replaces or functions as one of the symbols on one of the reels after the reels initially spin and stop. Such wild symbols enable a first or non-winning combination of symbols to change to a second and possibly winning combination of symbols (e.g., to make a winning combination or align a winning combination on an active payline). Such wild symbols further enable a first winning combination of symbols associated with a first award amount to change to a second winning combination of symbols associated with a second, more lucrative award amount.

As wild symbols increase the level of enjoyment and excitement for certain players, there is a continuing need to employ wild symbols in new and different games. There is also a continuing need to increase the level of excitement and entertainment for people playing gaming machines by providing better gaming experiences and environments at gaming machines. There is a further need for increasing the number of winning symbol combinations generated and awards provided to a player for a single wager on a play of a game.

SUMMARY

The present disclosure relates generally to gaming systems and methods for providing a multi-dimensional symbol game with expanding wild symbols.

In various embodiments, the gaming system disclosed herein includes a symbol game which utilizes a plurality of adjacent symbol display position grids arranged at a plurality of different depths. Each symbol display position grid includes a plurality of symbol display positions. Each symbol display position of each symbol display position grid is associated with a specific height position in the symbol display position grid (e.g., a specific row), a specific width position in the symbol display position grid (e.g., a specific column) and a specific depth (i.e., the depth of the symbol display position grid). A plurality of symbols including zero, one or more wild symbols are associated with or otherwise available to be generated at each of the symbol display positions.

In operation of such embodiments, for a play of a wagered on game, the gaming system generates one of a plurality of symbols at each of the symbol display positions of each of the symbol display position grids. In one such embodiment, the gaming system evaluates the generated symbols displayed to the player, accounting for any generated wild symbols, to determine if any winning symbols or winning symbol combinations are formed.

In various embodiment, in addition (or alternative) to determining if any winning symbols or winning symbol combinations are formed, the gaming system determines if wild symbols are generated at related symbol display positions. If the gaming system determines that wild symbols are generated at related symbol display positions, the gaming system modifies one or more generated non-wild symbols into one or more wild symbols. in one such embodiment, this modification includes causing one of the wild symbols displayed in one of the related symbol display positions to expand into another symbol display position, such as a symbol display position adjacent to one or more of the related symbol display positions. It should be appreciated that the related symbol display positions may be in the same symbol display position grid at the same depth or may be in different symbol display position grids at different depths. That is: (i) if two related symbol display positions are in the same symbol display position grid at the same depth, the gaming system expands one of the wild symbols to another symbol display position in the same symbol display position grid at the same depth, and (ii) if two related symbol display positions are in different symbol display position grids at different depths, the gaming system expands one of the wild symbols to another symbol display position in another symbol display position grid at another depth.

In one such embodiment, the related symbol display positions are adjacent to each other such that if the gaming system generates wild symbols in adjacent symbol display positions, the gaming system expands one of the generated wild symbols into a symbol display position adjacent to one of such symbol display positions. Put differently, the wild symbols are extrapolating wilds wherein the gaming system causes a symbol to the outside of the adjacently generated wild symbols to turn into a wild symbol. In another such embodiment, the related symbol display positions are not adjacent to each other such that if the gaming system generates wild symbols in non-adjacent, related symbol display positions, the gaming system expands one of the generated wild symbols into a symbol display position adjacent to at least one of such symbol display positions. Put differently, the wild symbols are interpolating wilds wherein the gaming system causes a symbol to the inside of non-adjacently generated wild symbols to turn into a wild symbol. In another such embodiment, the related symbol display positions are either: (i) adjacent to each other such that if the gaming system generates wild symbols in adjacent symbol display positions, the gaming system expands one of the generated wild symbols into a symbol display position adjacent to one of such symbol display positions, or (ii) not adjacent to each other such that if the gaming system generates wild symbols in non-adjacent, related symbol display positions, the gaming system expands one of the generated wild symbols into a symbol display position adjacent to at least one of such symbol display positions. As described above, in these embodiments, the gaming system causes zero, one or more wild symbols to expand into zero, one or more symbol display positions in either the same symbol display position grid at the same depth or a different symbol display position grid at a different depth.

Following the expansion of zero, one or more generated wild symbols into zero, one or more symbol display positions, the gaming system determines if any wild symbols, including any generated wild symbols and any expanded wild symbols, are displayed at any related symbol display positions. If any wild symbols, including any generated wild symbols and any expanded wild symbols, are displayed at any related symbol display positions, the gaming system causes one of such wild symbols to expand into another symbol display position as described above. The gaming system repeats this process until determining that wild symbols, including any generated wild symbols and any expanded wild symbols, are not displayed at any related symbol display positions. It should be appreciated that the repeated expansion of one or more wild symbols (caused by one expanded wild symbol triggering a further expansion of that wild symbol or triggering the expansion of another wild symbol) creates a wild symbol expansion frenzy which increases the level of excitement and enjoyment for certain players. Such a configuration provides the player with additional opportunities to win awards in association with a plurality of matrices of symbol display positions.

In one embodiment, following each individual expansion of a wild symbol into another symbol display position (i.e., following each individual determination to modify or turn one or more non-wild symbols into one or more wild symbols), the gaming system evaluates the generated symbols displayed to the player, accounting for any generated wild symbols and any expanded wild symbols, to determine if any winning symbols or winning symbol combinations are formed. In another embodiment, upon the determination that wild symbols, including any generated wild symbols and any expanded wild symbols, are not displayed at any related symbol display positions, the gaming system evaluates the generated symbols displayed to the player, accounting for any generated wild symbols and any expanded wild symbols, to determine if any winning symbols or winning symbol combinations are formed. In these embodiments, if the gaming system expands a wild symbol into a symbol display position displaying a non-wild symbol (i.e., if the gaming system modifies a non-wild symbol into a wild symbol based on the presence of one or more other wild symbols), the gaming system causes that wild symbol to function as or otherwise change to a different symbol, such as a symbol that causes a non-winning symbol combination to become a winning symbol combination. In these embodiments, following one or more of such evaluations (including any evaluation occurring prior to any expansion of any generated wild symbols), the gaming system provides the player any awards associated with any formed winning displayed symbols or any formed winning displayed symbol combinations.

The gaming system and method of the present disclosure thus provides a game having increased volatility due to the utilization of a plurality of symbol display position grids of different depths. Specifically, the gaming system provides a player with an opportunity to win multiple awards for a single play of the game based on the expansion of one or more wild symbols in one symbol display position grid to cause one or more non-wild symbols in the same or another symbol display position grid to become wild symbols for additional award determinations during the same play of the game.

Additional features and advantages are described in, and will be apparent from, the following Detailed Description and the figures.

DETAILED DESCRIPTION

Multiple Dimension Expanding Wild Symbols

In various embodiments, the gaming system disclosed herein relates generally to gaming systems and methods for providing a multi-dimensional symbol game with expanding wild symbols.

While the embodiments described below are directed to a primary or base game, it should be appreciated that the present disclosure may additionally or alternatively be employed in association with a secondary or bonus game. Moreover, while the player's credit balance, the players wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

Figure 1:
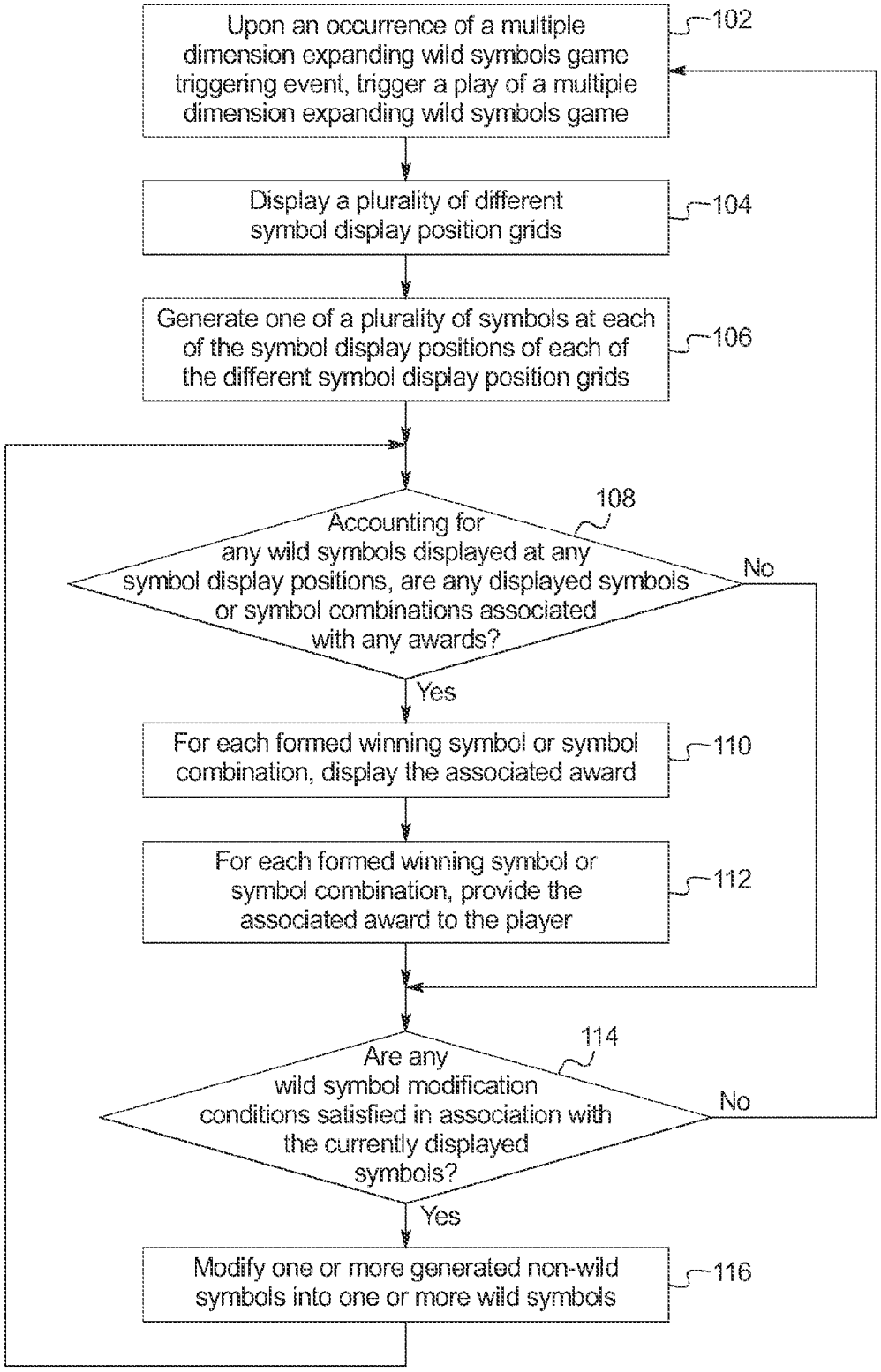
FIG. 1 is a flow chart an example process for operating a gaming system providing the multi-dimensional symbol game with expanding wild symbols disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In various embodiments, upon an occurrence of a multiple dimension expanding wild symbols game triggering event, as indicated in block 102 of FIG. 1, the gaming system initiates or triggers a play of a multiple dimension expanding wild symbols game. In one embodiment, the multiple dimension expanding wild symbols game is a primary game wherein a multiple dimension expanding wild symbols game triggering event occurs upon a player placing a wager to play the multiple dimension expanding wild symbols game. In another embodiment, the multiple dimension expanding wild symbols game is a secondary or bonus game wherein a multiple dimension expanding wild symbols game triggering event occurs based on a displayed event associated with a wagered on play of a primary game. In another embodiment wherein the multiple dimension expanding wild symbols game is a secondary or bonus game, a multiple dimension expanding wild symbols game triggering event occurs based on an event independent of any displayed event associated with a wagered on play of a primary game.

For the initiated multiple dimension expanding wild symbols game, the gaming system displays a plurality of different symbol display position grids or matrices as indicated in block 104. In one embodiment, each symbol display position grid includes a plurality of symbol display positions arranged in a plurality of rows and a plurality of columns. Each symbol display position grid also has a different depth. Thus, in certain embodiments, each symbol display position of each symbol display position grid is associated with a specific row, a specific column and a specific depth. Moreover, in each symbol display position grid, one or more symbol display positions are aligned with or otherwise correspond with one or more symbol display positions of one or more symbol display position grids of different depths. That is, one or more symbol display position grids are positioned (relative to the player's line of sight) behind one or more other symbol display position grids and thus one or more symbol display positions of one or more symbol display position grids are positioned (relative to the player's line of sight) behind one or more symbol display positions of one or more other symbol display position grids.

In one embodiment, one or more paylines of any suitable direction extend through a plurality of symbol display positions of a symbol display position grid at one depth. In another embodiment, one or more paylines of any suitable direction extend through a plurality of symbol display positions of a plurality of symbol display position grids at a plurality of different depths. In these embodiment, the gaming system enables the player to wager on one or more of such paylines. In another embodiment, one or more ways to win are associated with a plurality of symbol display positions of a symbol display position grid at one depth. In another embodiment, one or more ways to win are associated with a plurality of symbol display positions of a plurality of symbol display position grids at a plurality of different depths. In these embodiment, the gaming system enables the player to wager on quantity of active symbol display positions or a quantity of ways to win.

Following the display of the plurality of symbol display positions of the plurality of symbol display position grids of different depths, the gaming system generates one of a plurality of symbols at each of the symbol display positions of each of the different symbol display position grids as indicated in block 106. In certain embodiments, based on the plurality of symbols being displayed at the plurality of symbol display positions at the plurality of symbol display position grids of different depths causing one or more symbols to be in the foreground (relative to the player's line of sight) and one or more symbols to be in the background (relative to the player's line of sight), the gaming system causes the plurality of symbol display position grids to rotate to enable the player to view each of the generated symbols at different angles for a single play of the game. In one such embodiment, the gaming system enables the player to rotate the symbol display position grids. In another such embodiment, the gaming system rotates the symbol display position grids independent of any player input.

It should be appreciated that zero, one or more of the generated symbols are wild symbols. In various embodiments, each generated wild symbol functions as or otherwise changes to a different symbol, such as a symbol that causes a non-winning symbol combination to become a winning symbol combination. In one such embodiment, if the gaming system generates a wild symbol at a symbol display position, the gaming system causes that wild symbol to function as a symbol that completes a winning symbol combination (e.g., the highest winning symbol combination) along one of the paylines. In another such embodiment, if the gaming system generates a wild symbol at a symbol display position, the gaming system causes that wild symbol to function as a symbol that changes a first winning symbol combination associated with a first award to a second, different winning symbol combination associated with a second, more lucrative award. In another such embodiment, if the gaming system generates a wild symbol at a symbol display position, the gaming system causes the wild symbol to substitute for one of the symbols indicated on the same payline as the wild symbol. In another such embodiment, if the gaming system generates a wild symbol at a symbol display position, the gaming system causes the wild symbol to match or substitute for a designated symbol on a payline, such as a jackpot symbol or the symbol associated with the largest award in the game.

In one embodiment, each symbol display position grid is associated with a different set of a plurality of reels. In this embodiment, when the gaming system generates one of a plurality of symbols at each of the symbol display positions of each of the different symbol display position grids, the gaming system causes each of the sets of reels to generate one or more symbols for the symbol display position grid associated with that set of reels. In another embodiment, each symbol display position of each symbol display position grid is associated with a unisymbol reel. In another embodiment, a plurality of the symbol display position of one, more or each of the symbol display position grids are each associated with a unisymbol reel. In another embodiment, the plurality of symbol display position grids are associated with a single set of a plurality of reels. In this embodiment, each reel of the plurality of reels is associated with a plurality of symbol stacks. In another embodiment, one or more symbol display positions of one or more symbol display position grids are associated with different sets of reels and one or more symbol display positions of one or more symbol display position grids are associated with one or more symbol stacks.

Following the generation of the plurality of symbols at each symbol display position, the gaming system determines if, when accounting for any wild symbols displayed at any symbol display positions, any of the displayed symbols (or symbol combinations) are associated with any awards as indicated in diamond 108 of FIG. 1. That is, for the initiated game, the gaming system determines whether the displayed symbols (including any displayed wild symbols) form any winning symbol combinations. It should be appreciated that because one or more paylines run through a plurality of different symbol display positions of a plurality of different symbol display grids of different depths, one or more winning symbol combinations are formed from symbols displayed at different depths. That is, when determining if any awards are associated with the currently displayed symbols, the gaming system may evaluate symbols displayed at a plurality of symbol display positions of a plurality of symbol display position grids of a plurality of different depths. Such a configuration provides the player with additional opportunities to win awards in association with a plurality of grids of symbol display positions.

If at least one winning combination of displayed symbols is formed, for each formed winning combination of displayed symbols, the gaming system displays the associated award and provides the associated award to the player as indicated in blocks 110 and 112.

Following providing the player any awards associated with any displayed winning symbol combinations or if no winning combination of displayed symbols is formed, the gaming system determines if any wild symbol modification conditions are satisfied in association with the currently displayed symbols as indicated in diamond 114.

In one embodiment, a wild symbol modification is satisfied if wild symbols are displayed at related symbol display positions. In one such embodiment, the related symbol display positions are adjacent to each other and in the same symbol display position grid of the same depth. In another such embodiment, the related symbol display positions are adjacent symbol display positions in different symbol display position grids of different depths.

In another such embodiment, the related symbol display positions are in the same symbol display position grid of the same depth and are not adjacent to each other. In another such embodiment, the related symbol display positions are not adjacent symbol display positions and are in different symbol display position grids of different depths. In another such embodiment, the related symbol display positions are in the same symbol display position grid of the same depth and are not adjacent to each other, but are each located along the same payline. In another such embodiment, the related symbol display positions are not adjacent symbol display positions and are in different symbol display position grids of different depths, but are each located along the same payline.

In another such embodiment, the related symbol display positions are in the same symbol display position grid of the same depth and are either adjacent to each other or non-adjacent to each other. In another such embodiment, the related symbol display positions are in different symbol display position grids of different depths and are either adjacent to each other or non-adjacent to each other. In another such embodiment, the related symbol display positions are in the same symbol display position grid of the same depth and are either adjacent to each other or non-adjacent to each other and are each located along the same payline. In another such embodiment, the related symbol display positions are in different symbol display position grids of different depths, are either adjacent to each other or non-adjacent to each other and are each located along the same payline.

If the gaming system determines that no wild symbol modification condition is satisfied, the gaming system ends the play of the game, returns to block 102 and awaits another occurrence of the multiple dimension expanding wild symbols game triggering event.

On the other hand, if the gaming system determines that at least one wild symbol modification condition is satisfied, the gaming system modifies one or more generated non-wild symbols into one or more wild symbols as indicated in block 116. That is, upon the satisfaction of a wild symbol modification condition, the gaming system expands (or replicates) a wild symbol displayed at a symbol display position into one or more other symbol display positions. In one such embodiment, if the gaming system determines that wild symbols are displayed in related symbol display positions, the gaming system causes one of such wild symbols to expand, move or replicate into another symbol display position, such as a symbol display position adjacent to one or more of the related symbol display positions.

It should be appreciated that the related symbol display positions may be in the same symbol display position grid at the same depth or may be in different symbol display position grids at different depths. That is, in one such embodiment: (i) if two related symbol display positions are in the same symbol display position grid at the same depth, the gaming system expands one of the wild symbols to another symbol display position in the same symbol display position grid at the same depth, and (ii) if two related symbol display positions are in different symbol display position grids at different depths, the gaming system expands one of the wild symbols to another symbol display position in another symbol display position grid at another depth. In another such embodiment, in addition or alternative to (i) and (ii) above, (ii) if two related symbol display positions are in the same symbol display position grid at the same depth, the gaming system expands one of the wild symbols to another symbol display position in a symbol display position grid at a different depth, and (iv) if two related symbol display positions are in different symbol display position grids at different depths, the gaming system expands one of the wild symbols to another symbol display position in the symbol display position grid at one of the different depths.

In one such embodiment, the related symbol display positions are adjacent to each other such that if the gaming system displays wild symbols in adjacent symbol display positions, the gaming system expands one of the generated wild symbols into a symbol display position adjacent to one of such symbol display positions, wherein such an adjacent symbol display position may include being at a same depth or a different depth of the symbol display position of the displayed wild symbol. In another such embodiment, the related symbol display positions are not adjacent to each other such that if the gaming system displays wild symbols in non-adjacent, related symbol display positions, the gaming system expands one of the generated wild symbols into a symbol display position adjacent to at least one of such symbol display positions. In another such embodiment, the related symbol display positions are not adjacent to each other but are each located along a same payline such that if the gaming system displays wild symbols in non-adjacent, related symbol display positions, the gaming system expands one of the generated wild symbols into a symbol display position adjacent to at least one of such symbol display positions on the same payline. In another such embodiment, the related symbol display positions are not adjacent to each other but are each located along a same payline such that if the gaming system displays wild symbols in non-adjacent, related symbol display positions, the gaming system expands one of the generated wild symbols into a symbol display position on the same payline. In another such embodiment, the related symbol display positions are either: (i) adjacent to each other such that if the gaming system displays wild symbols in adjacent symbol display positions, the gaming system expands one of the displayed wild symbols into a symbol display position adjacent to one of such symbol display positions, or (ii) not adjacent to each other such that if the gaming system displays wild symbols in non-adjacent, related symbol display positions, the gaming system expands one of the displayed wild symbols into a symbol display position adjacent to at least one of such symbol display positions.

Following the expansion of one or more wild symbols into one or more symbol display positions, the gaming system returns to diamond 108 and proceeds as described above with determining if, when accounting for any wild symbols displayed at any symbol display positions, any of the displayed symbols (or symbol combinations) are associated with any awards. It should be appreciated that any wild symbols displayed at any symbol display positions include wild symbols generated at such symbol display positions and/or wild symbols expanded into such symbol display positions. It should be further appreciated that the repeated expansion of one or more wild symbols (caused by one expanded wild symbol triggering a further expansion of that wild symbol or triggering the expansion of another wild symbol) creates a wild symbol expansion frenzy which increases the level of excitement and enjoyment for certain players. Such a configuration provides the player with additional opportunities to win awards in association with a plurality of matrices of symbol display positions.

Figure 2A:
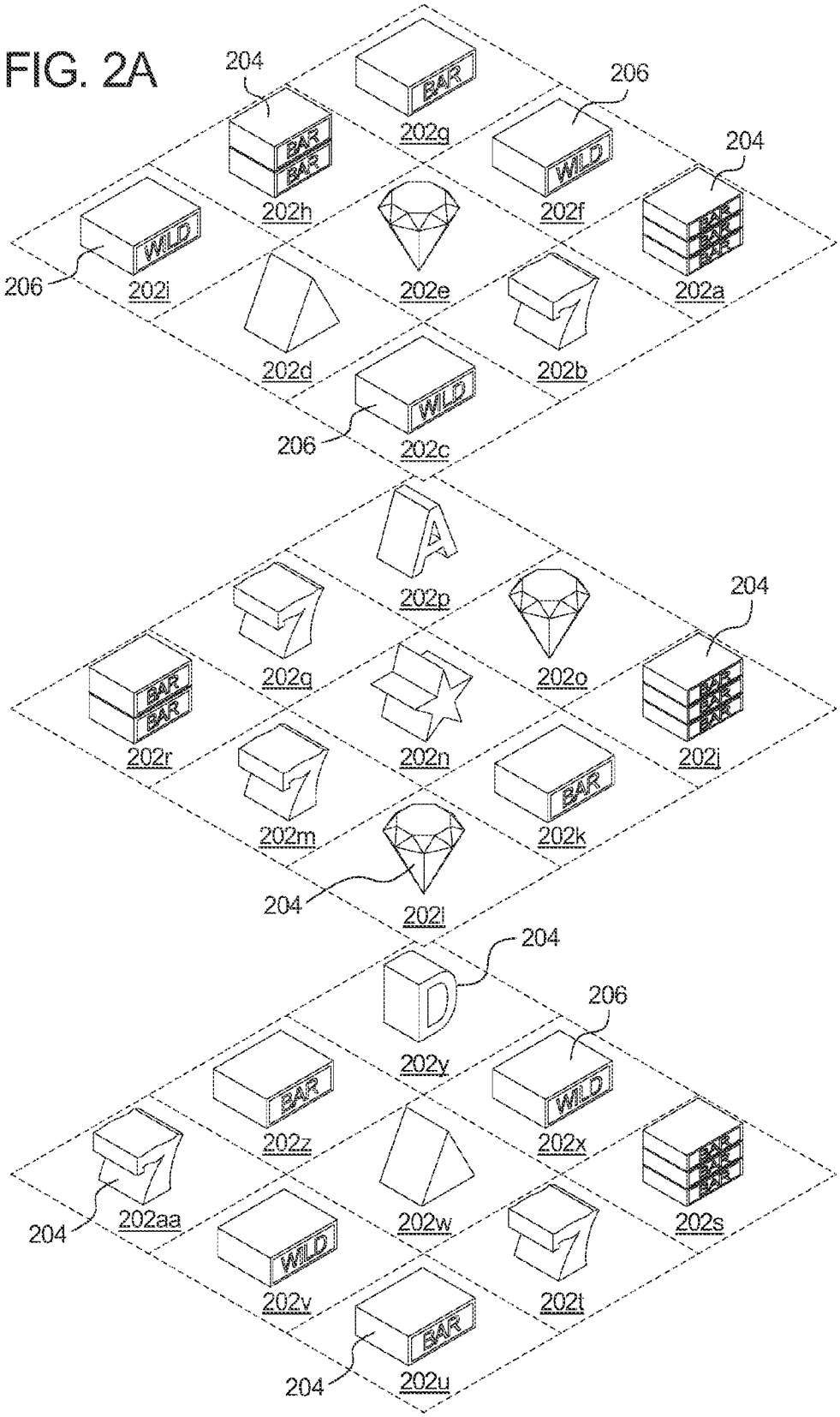
FIG. 2A is a front exploded perspective view of one embodiment of the gaming system disclosed herein illustrating a plurality of symbols generated in a plurality of symbol display positions of a plurality of symbol display position grids at a plurality of different depths.
Figure 2B:
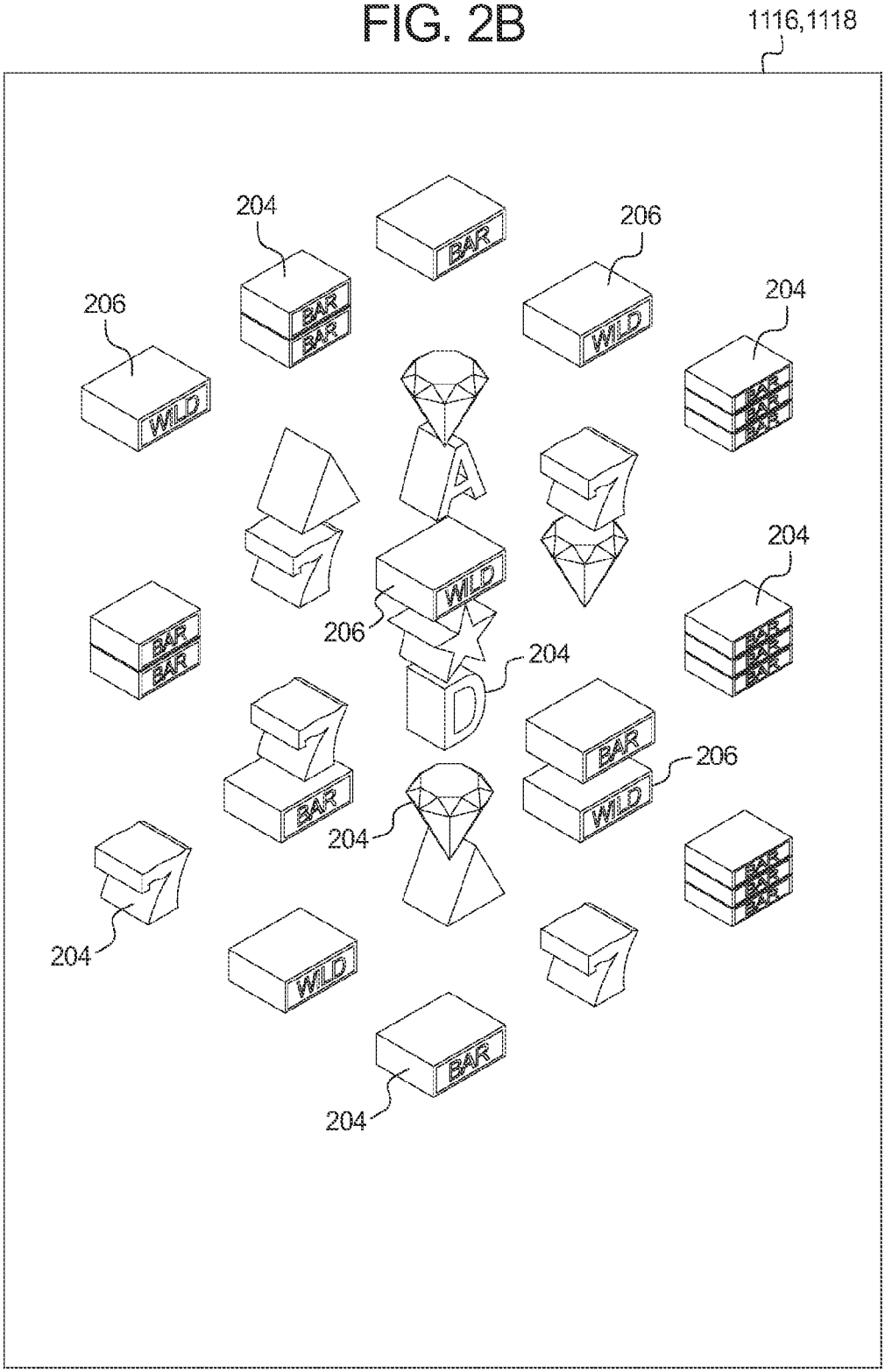
FIGS. 2B, 2C, 2D, 2E and 2F are front views of the embodiment of the gaming system of FIG. 2A illustrating a play of the multi-dimensional symbol game with interpolating wild symbols.

In one embodiment, as described above, a wild symbol modification condition is satisfied based on wild symbols being displayed (either by being generated at or being expanded into) at non-adjacent related symbol display positions. As illustrated in the different views of FIGS. 2A and 2B, in one example embodiment of a play of the multi-dimensional symbol game incorporating expanding wild symbols disclosed herein, the gaming system generates a plurality symbols (including wild symbols 206 and non-wild symbols 204) at a plurality of symbol display positions 202*a* to 202*aa* at each of a plurality of symbol display position grids of different depths.

Figure 2C:
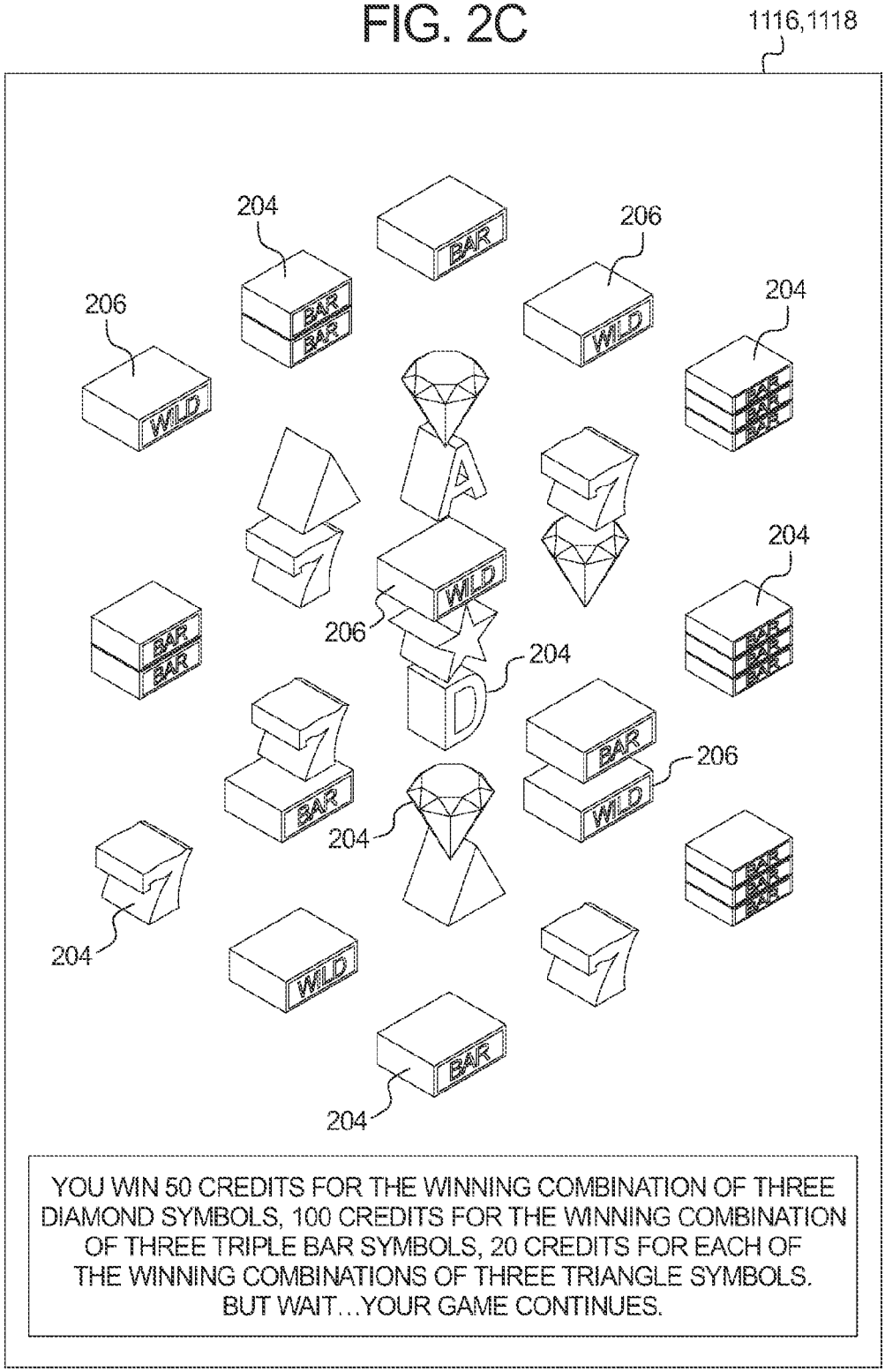

As seen in FIG. 2C, after generating a plurality of symbols, the gaming system determines that, based on each generated wild symbol functioning as or otherwise changing to a different symbol: (i) the displayed symbol combination of wild symbol—diamond symbol—wild symbol in symbol display positions 202*f*, 202*o* and 202*x*, respectively, is a winning symbol combination associated with an award of fifty credits, (ii) the displayed symbol combination of triple bar symbol—triple bar symbol—triple bar symbol in symbol display positions 202*a*, 202*j* and 202*s*, respectively, is a winning symbol combination associated with an award of one-hundred credits, (iii) the displayed symbol combination of wild symbol—triangle symbol—wild symbol in symbol display positions 202*c*, 202*d* and 202*i*, respectively, is a winning symbol combination associated with an award of twenty credits, (iv) the displayed symbol combination of wild symbol—triangle symbol—wild symbol in symbol display positions 202*v*, 202*w* and 202*x*, respectively, is a winning symbol combination associated with an award of twenty credits. Accordingly, the gaming system provides an award of one-hundred-ninety credits to the player and provides appropriate messages such as "YOU WIN 50 CREDITS FOR THE WINNING COMBINATION OF THREE DIAMOND SYMBOLS, 100 CREDITS FOR THE WINNING COMBINATION OF THREE TRIPLE BAR SYMBOLS, 20 CREDITS FOR EACH OF THE WINNING COMBINATIONS OF THREE TRIANGLE SYMBOLS" and "BUT WAIT . . . YOUR GAME CONTINUES" to the player visually, or through suitable audio or audiovisual displays.

It should be appreciated that while this example includes one or more paylines that generally run along the different rows and columns formed by the symbol display positions of the symbol display position grids, one or more diagonal paylines or paylines running in any suitable direction may be implemented in association with this example. For example, illustrating one or more diagonal paylines, the gaming system may additionally or alternatively determine that the displayed symbol combination of wild symbol—star symbol—wild symbol in symbol display positions 202*v*, 202*n* and 202*f* of FIG. 2C, respectively, is a winning symbol combination associated with an award of thirty credits. Accordingly, while this example, for ease of illustration, highlights winning symbol combinations located along vertical and/or horizontal paylines, any suitable payline running in any suitable direction, including, but not limited to, vertical paylines, horizontal paylines, diagonal paylines, paylines that extend in one or more different directions, paylines that extend through a plurality of symbol display positions of a symbol display position grid at one depth, and/or paylines that extend through a plurality of symbol display positions of a plurality of symbol display position grids at a plurality of different depths may be implemented in association with determining winning symbol combinations of this example and/or any embodiment suitably disclosed herein.

Figure 2D:
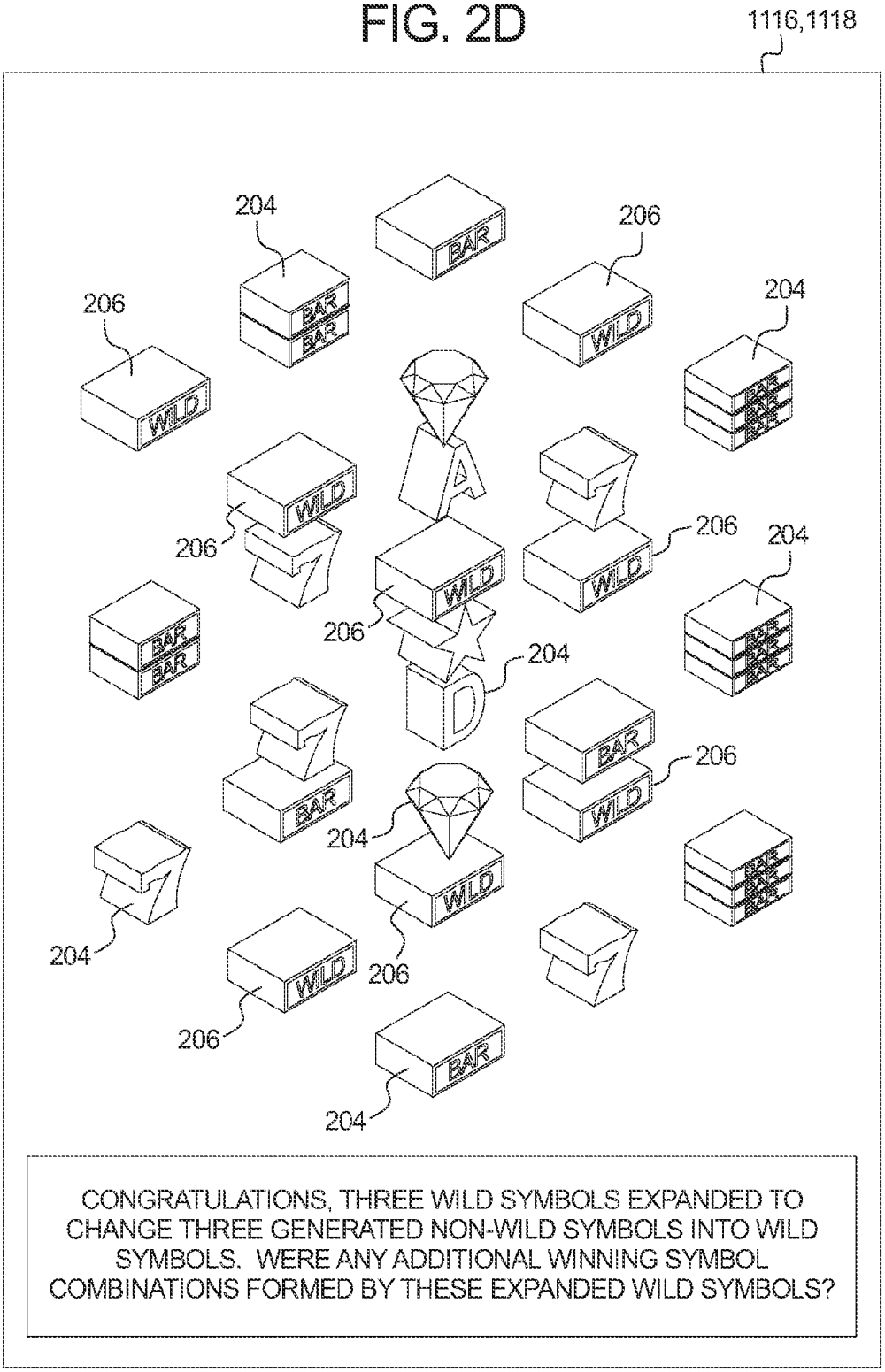

In this example, the gaming system then determines that, based on certain of the generated wild symbols being generated in certain non-adjacent related symbol display positions, three wild symbol modification conditions are satisfied. Accordingly, as seen in FIG. 2D, the gaming system modifies: (i) diamond symbol in symbol display position 202*o* (which is related to symbol display position 202*f* and symbol display position 202*x* which both include wild symbols 206) into a wild symbol 206, (ii) triangle symbol in symbol display position 202*d* (which is related to symbol display position 202*c* and symbol display position 202*i* which both include wild symbols 206) into a wild symbol 206, and (iii) triangle symbol in symbol display position 202*w* (which is related to symbol display position 202*x* and symbol display position 202*v* which both include wild symbols 206) into a wild symbol 206. In this example, the gaming system provides appropriate messages such as "CONGRATULATIONS, THREE WILD SYMBOLS EXPANDED TO CHANGE THREE GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

It should be appreciated that while this example includes determining whether zero, one or more wild symbol modification conditions are satisfied based on any wild symbols displayed in any non-adjacent related symbol display positions located along the different rows and columns formed by the symbol display positions of the symbol display position grids, any configuration of non-adjacent related symbol display positions may be analyzed to determine if any wild symbol modification conditions are satisfied. For example, illustrating one or more diagonal alignments of non-adjacent related symbol display positions, the gaming system may additionally or alternatively modify, as seen in FIG. 2C, star symbol in symbol display position 202*n* (which is related to symbol display position 202*v* and symbol display position 202*f* which both include wild symbols) into a wild symbol. Accordingly, while this example, for ease of illustration, highlights determining if any wild symbol modifications are satisfied based on non-adjacent related symbol display positions located along vertically aligned symbol display positions and/or horizontally aligned symbol display positions, any suitable alignment of non-adjacent related symbol display positions, including, but not limited to, vertically aligned non-adjacent related symbol display positions, horizontally aligned non-adjacent related symbol display positions, diagonally aligned non-adjacent related symbol display positions, non-adjacent related symbol display positions extending in one or more different directions, non-adjacent related symbol display positions in one symbol display position grid at one depth, and/or non-adjacent related symbol display positions in a plurality of symbol display position grids at a plurality of different depths may be implemented in association with determining if any wild symbol modification conditions are satisfied in this example and/or any embodiment suitably disclosed herein.

Figure 2E:
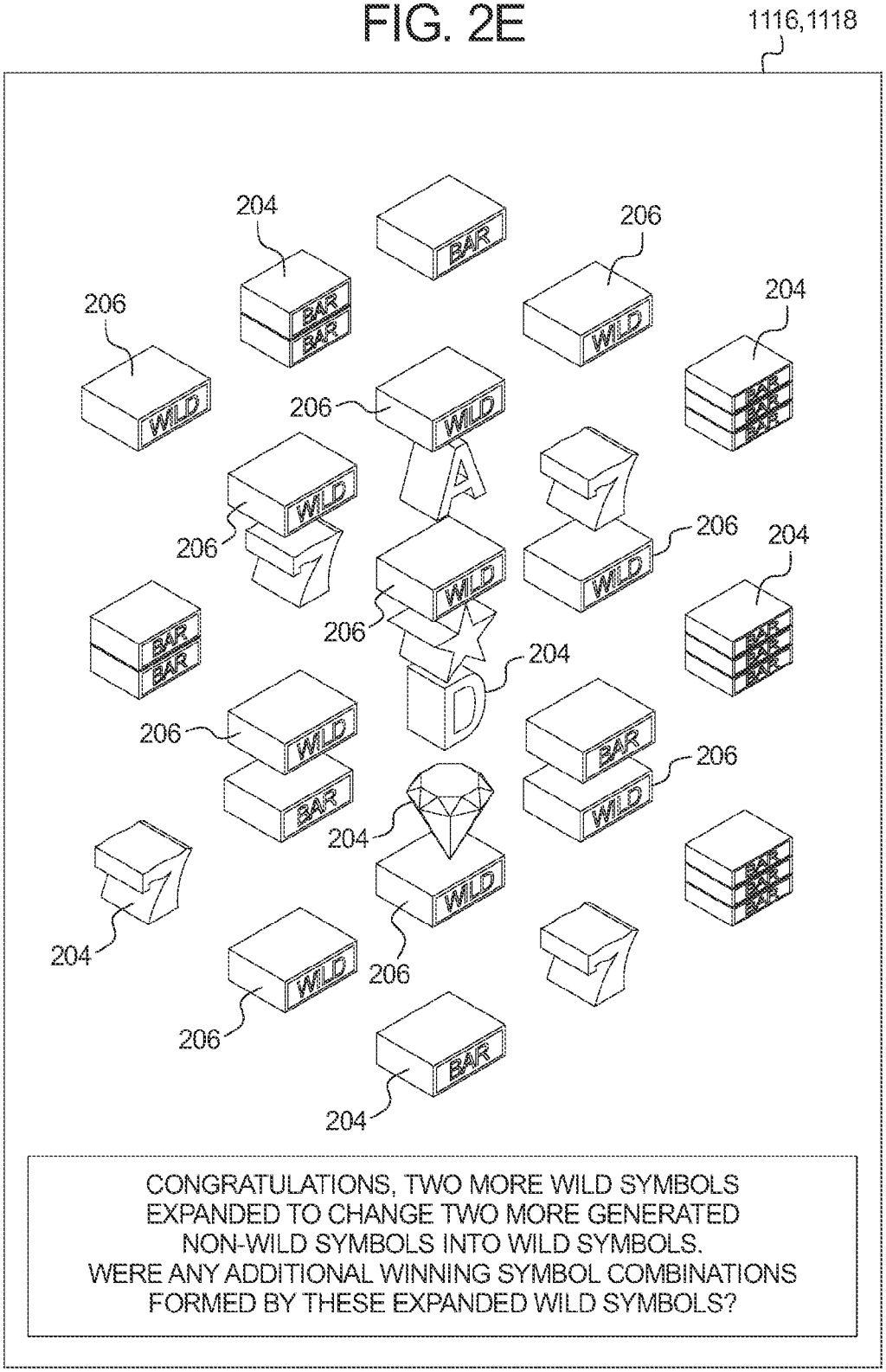

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that, based on certain of the displayed wild symbols (including both generated wild symbols and expanded wild symbols) being displayed in certain non-adjacent related symbol display positions, two more wild symbol modification conditions are satisfied. Accordingly, as seen in FIG. 2E, the gaming system modifies: (i) diamond symbol in symbol display position 202*e* (which is related to symbol display position 202*d* and symbol display position 202*f* which now both include wild symbols 206) into a wild symbol 206, and (ii) seven symbol in symbol display position 202*m* (which is related to symbol display position 202*d* and symbol display position 202*v* which now both include wild symbols 206). In this example, the gaming system provides appropriate messages such as "CONGRATULATIONS, TWO MORE WILD SYMBOLS EXPANDED TO CHANGE TWO MORE GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

Figure 2F:
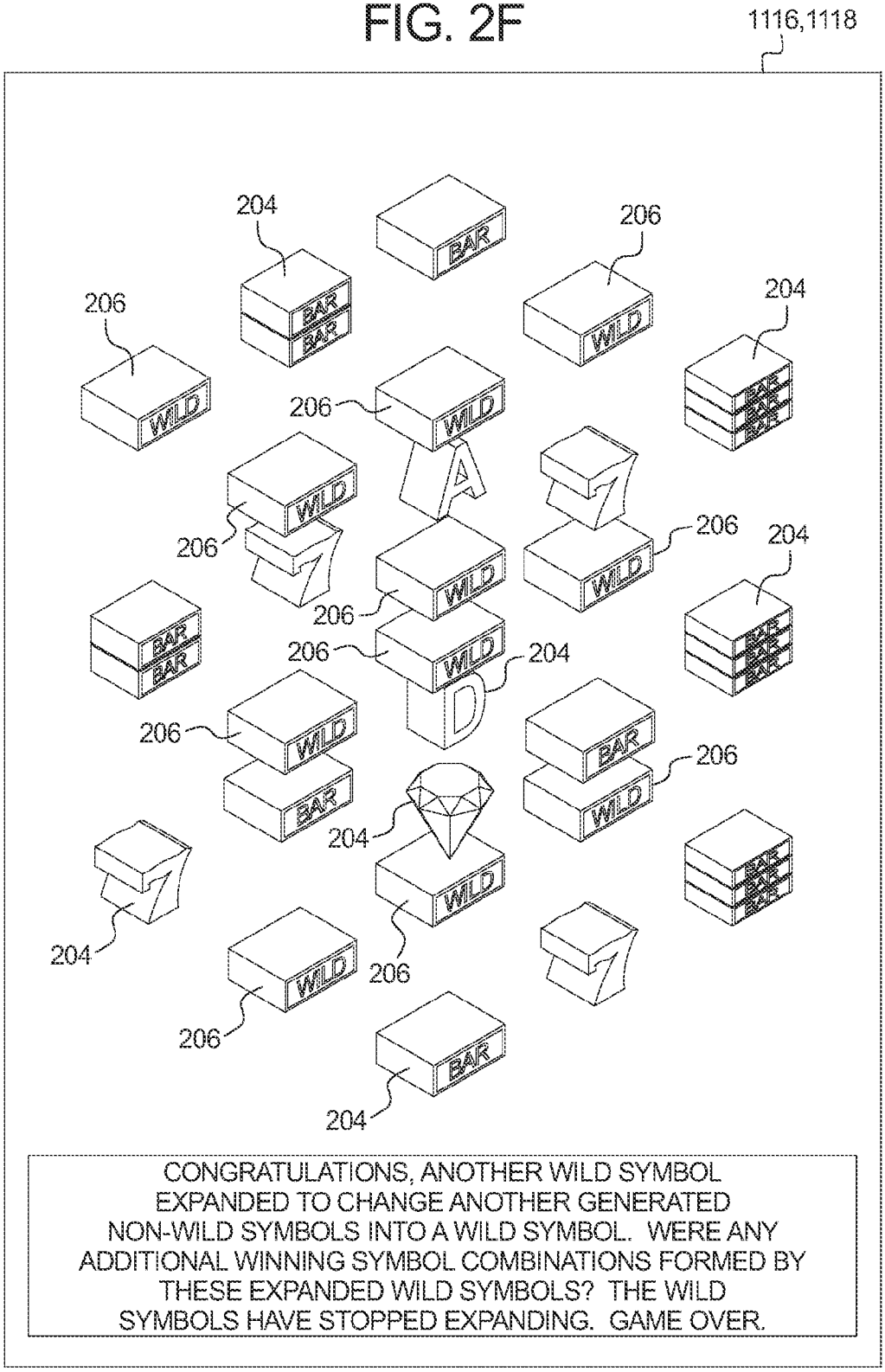

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that, based on certain of the displayed wild symbols (including both generated wild symbols and expanded wild symbols) being displayed in certain non-adjacent related symbol display positions, another wild symbol modification condition is satisfied. Accordingly, as seen in FIG. 2F, the gaming system modifies star symbol in symbol display position 202*n* (which is related to symbol display position 202*m* and symbol display position 202*o* which now both include wild symbols 206) into a wild symbol 206. It should be appreciated that star symbol in symbol display position 202*n* is also related to symbol display position 202*e* and symbol display position 202*w* which now both include wild symbols 206 and thus this symbol display position relationship also would have modified star symbol in symbol display position 202*n* into a wild symbol. In this example, the gaming system provides appropriate messages such as "CONGRATULATIONS, ANOTHER WILD SYMBOL EXPANDED TO CHANGE ANOTHER GENERATED NON-WILD SYMBOLS INTO A WILD SYMBOL" and "WERE ANY ADDITIONAL WINNING SYMBOL COMBINATIONS FORMED BY THESE EXPANDED WILD SYMBOLS?" to the player visually, or through suitable audio or audiovisual displays.

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that, based on none of the wild symbols (including both generated wild symbols and expanded wild symbols) being displayed in any non-adjacent related symbol display positions, no wild symbol modification condition is satisfied. In this example, no more wild symbols are expanded and the play of the multi-dimensional symbol game incorporating expanding wild symbols ends. As also seen in FIG. 2F, the gaming system provides appropriate messages such as "THE WILD SYMBOLS HAVE STOPPED EXPANDING" and "GAME OVER" to the player visually, or through suitable audio or audiovisual displays.

Figure 3A:
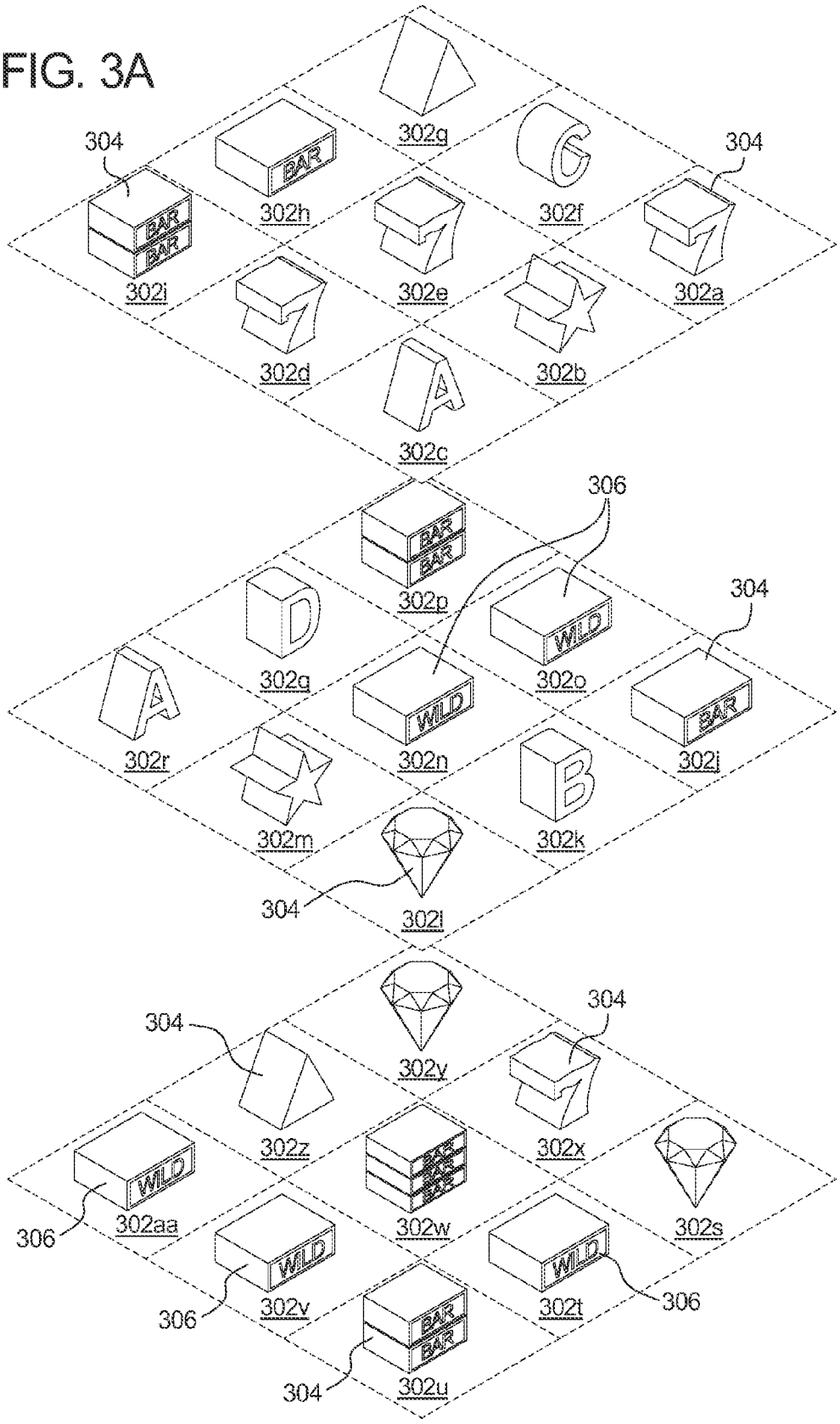
FIG. 3A is a front exploded perspective view of another embodiment of the gaming system disclosed herein illustrating a plurality of symbols generated in a plurality of symbol display positions of a plurality of symbol display position grids at a plurality of different depths.
Figure 3B:
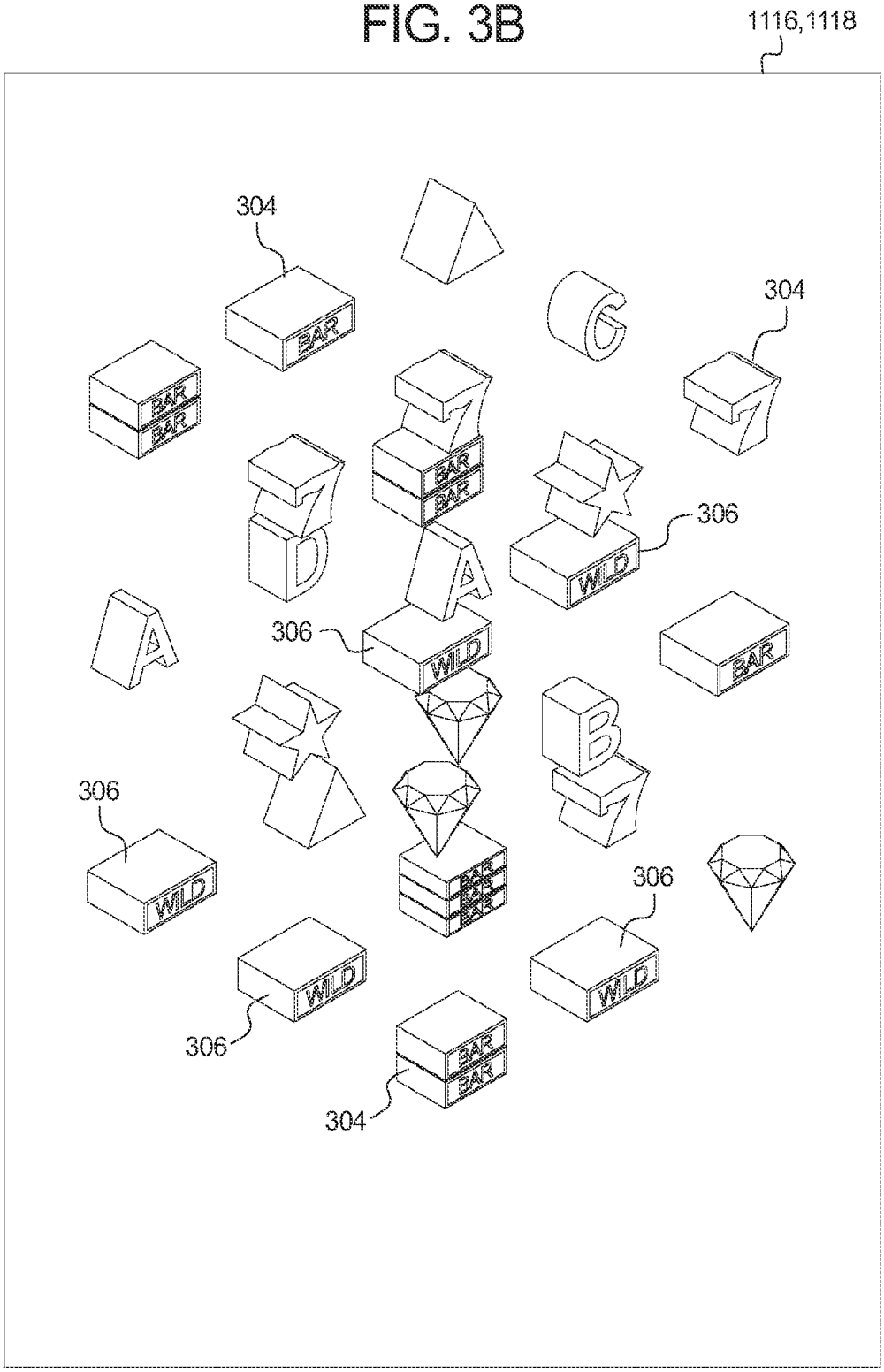
FIGS. 3B, 3C, 3D and 3E are front views of the embodiment of the gaming system of FIG. 3A illustrating a play of the multi-dimensional symbol game with extrapolating wild symbols.

In another embodiment, as described above, a wild symbol modification condition is satisfied based on wild symbols being displayed (either by being generated at or being expanded into) at adjacent related symbol display positions. As illustrated in the different views of FIGS. 3A and 3B, in one example embodiment of a play of the multi-dimensional symbol game incorporating expanding wild symbols disclosed herein, the gaming system generates a plurality symbols (including wild symbols 306 and non-wild symbols 304) at a plurality of symbol display positions 302*a* to 302*aa* at each of a plurality of symbol display position grids of different depths.

As seen in FIG. 30, after generating a plurality of symbols, the gaming system determines that, based on each generated wild symbol functioning as or otherwise changing to a different symbol: (i) the displayed symbol combination of star symbol—wild symbol—wild symbol in symbol display positions 302*m*, 302*n* and 302*o*, respectively, is a winning symbol combination associated with an award of two-hundred credits, and (ii) the displayed symbol combination of double bar symbol—wild symbol—wild symbol in symbol display positions 302*u*, 302*v* and 302*aa*, respectively, is a winning symbol combination associated with an award of seventy-five credits. Accordingly, the gaming system provides an award of two-hundred-seventy-five credits to the player and provides appropriate messages such as "YOU WIN 200 CREDITS FOR THE WINNING COMBINATION OF THREE STAR SYMBOLS AND 75 CREDITS FOR THE WINNING COMBINATION OF THREE DOUBLE BAR SYMBOLS" and "BUT WAIT . . . YOUR GAME CONTINUES" to the player visually, or through suitable audio or audiovisual displays.

It should be appreciated that while this example includes one or more paylines that generally run along the different rows and columns formed by the symbol display positions of the symbol display position grids, one or more diagonal paylines or paylines running in any suitable direction may be implemented in association with this example. For example, illustrating one or more diagonal paylines, the gaming system may additionally or alternatively determine that the displayed symbol combination of wild symbol—wild symbol—C symbol in symbol display positions 302*v*, 302*n* and 302*f* of FIG. 3C, respectively, is a winning symbol combination associated with an award of eighty credits. Accordingly, while this example, for ease of illustration, highlights winning symbol combinations located along vertical and/or horizontal paylines, any suitable payline running in any suitable direction, including, but not limited to, vertical paylines, horizontal paylines, diagonal paylines, paylines that extend in one or more different directions, paylines that extend through a plurality of symbol display positions of a symbol display position grid at one depth, and/or paylines that extend through a plurality of symbol display positions of a plurality of symbol display position grids at a plurality of different depths may be implemented in association with determining winning symbol combinations of this example and/or any embodiment suitably disclosed herein.

Figure 3C:
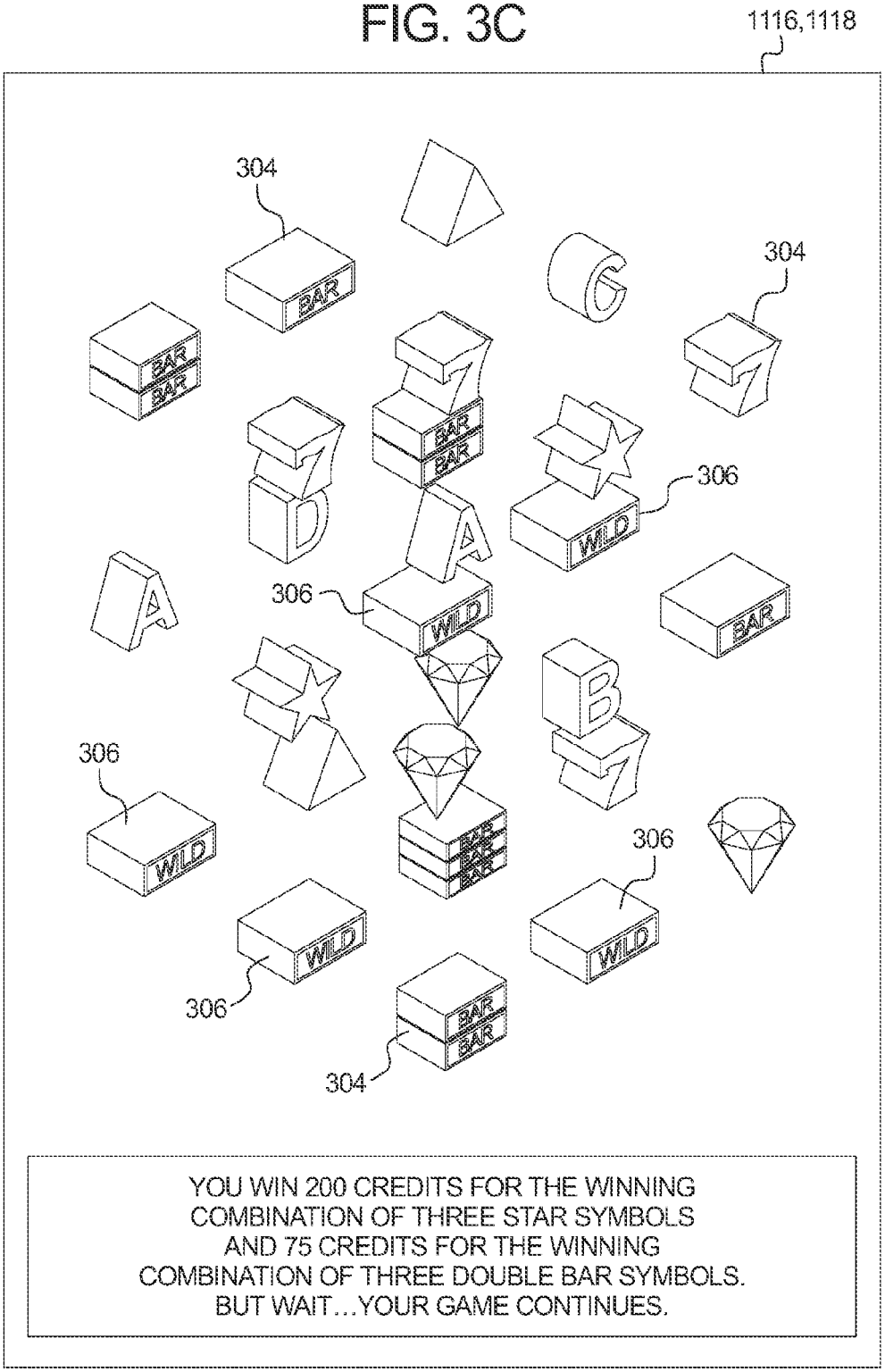
Figure 3D:
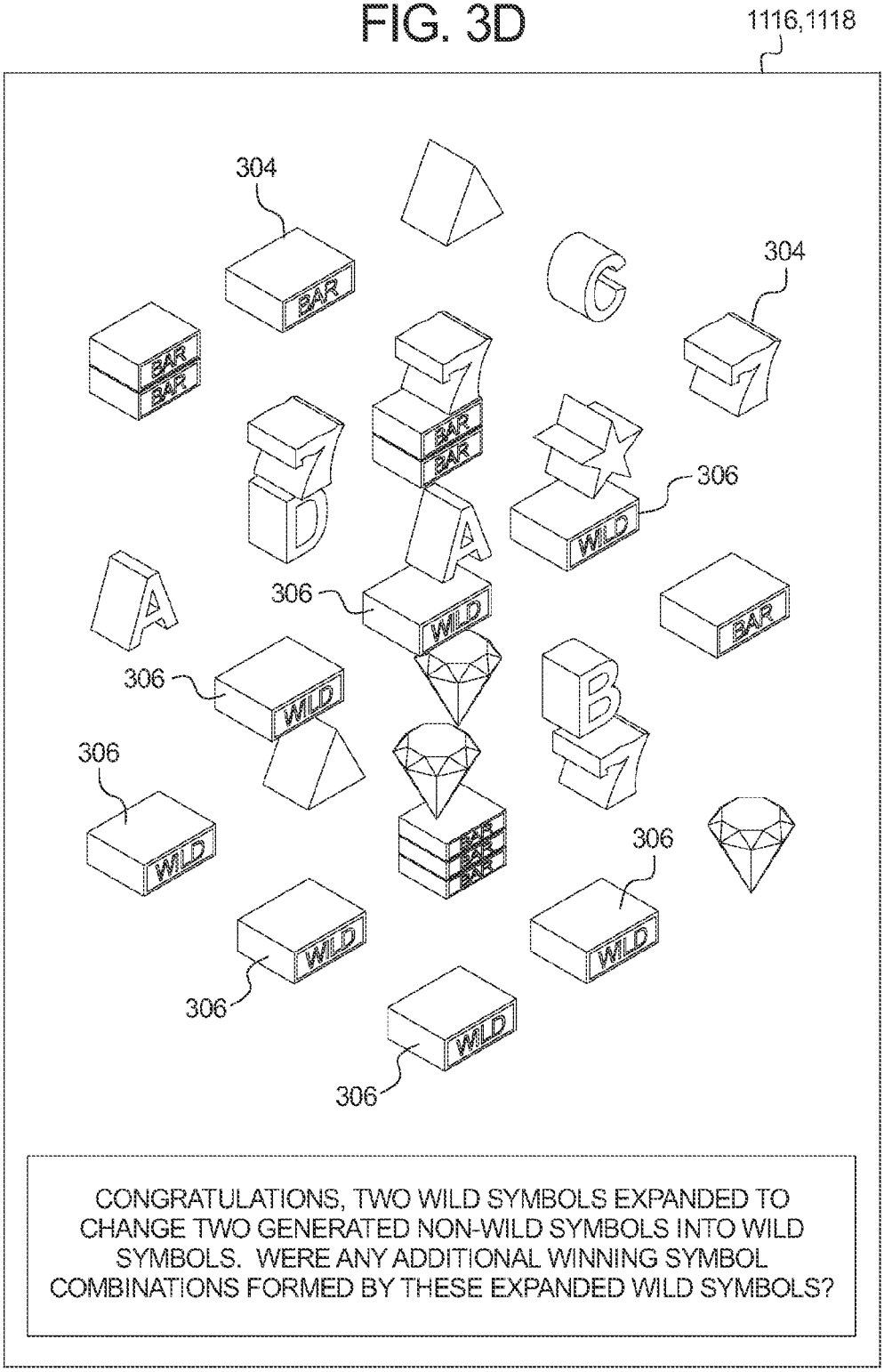

In this example, the gaming system then determines that, based on certain of the generated wild symbols being generated in certain adjacent related symbol display positions, two wild symbol modification conditions are satisfied. Accordingly, as seen in FIG. 3D, the gaming system modifies: (i) star symbol in symbol display position 302*m* (which is related to symbol display position 302*n* and symbol display position 3020 which both include wild symbols 306) into a wild symbol 306, and (ii) double bar symbol in symbol display position 302*u* (which is related to symbol display position 302*v* and symbol display position 302*aa* which both include wild symbols 306) into a wild symbol 306. In this example, the gaming system provides appropriate messages such as "CONGRATULATIONS, TWO WILD SYMBOLS EXPANDED TO CHANGE TWO GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

It should be appreciated that while this example includes determining whether zero, one or more wild symbol modification conditions are satisfied based on any wild symbols displayed in any adjacent related symbol display positions located along the different rows and columns formed by the symbol display positions of the symbol display position grids, any configuration of adjacent related symbol display positions may be analyzed to determine if any wild symbol modification conditions are satisfied. For example, illustrating one or more diagonal alignments of adjacent related symbol display positions, the gaming system may additionally or alternatively modify, as seen in FIG. 3C, C symbol in symbol display position 202*f* (which is related to symbol display position 202*v* and symbol display position 202*n* which both include wild symbols) into a wild symbol. Accordingly, while this example, for ease of illustration, highlights determining if any wild symbol modifications are satisfied based on adjacent related symbol display positions located along vertically aligned symbol display positions and/or horizontally aligned symbol display positions, any suitable alignment of adjacent related symbol display positions, including, but not limited to, vertically aligned adjacent related symbol display positions, horizontally aligned adjacent related symbol display positions, diagonally aligned adjacent related symbol display positions, adjacent related symbol display positions extending in one or more different directions, adjacent related symbol display positions in one symbol display position grid at one depth, and/or adjacent related symbol display positions in a plurality of symbol display position grids at a plurality of different depths may be implemented in association with determining if any wild symbol modification conditions are satisfied in this example and/or any embodiment suitably disclosed herein.

Figure 3E:
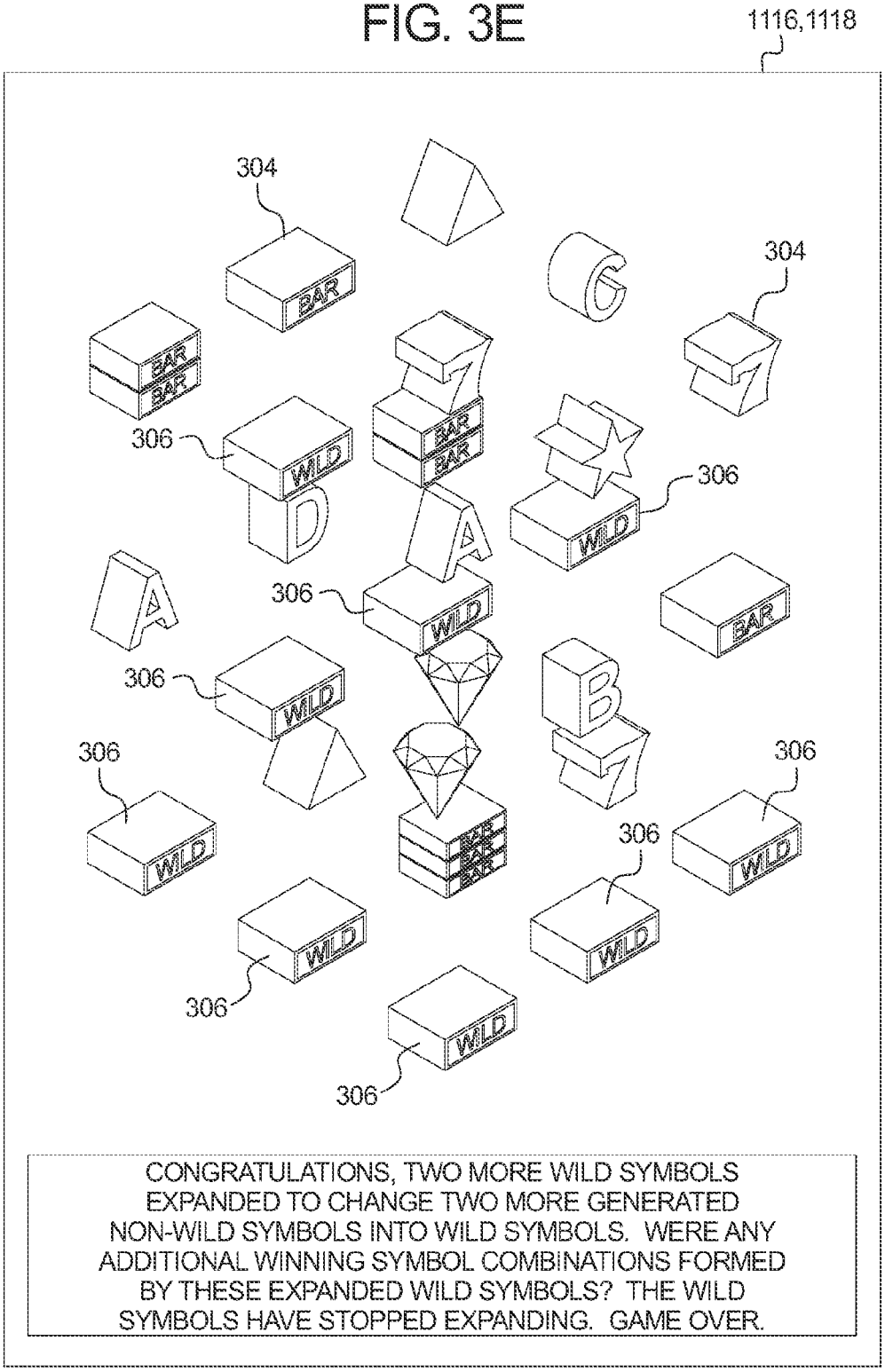

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that based on certain of the displayed wild symbols (including both generated wild symbols and expanded wild symbols) being displayed in certain adjacent related symbol display positions, two wild symbol modification conditions are satisfied. Accordingly, as seen in FIG. 3E, the gaming system modifies: (i) diamond symbol in symbol display position 302*s* (which is related to symbol display position 302*u* and symbol display position 302*t* which now both include wild symbols 306) into a wild symbol 306, and (ii) seven symbol in symbol display position 302*d* (which is related to symbol display position 302*m* and symbol display position 302*v* which now both include wild symbols 306). In this example, the gaming system provides appropriate messages such as "CONGRATULATIONS, TWO MORE WILD SYMBOLS EXPANDED TO CHANGE TWO MORE GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that, based on none of the wild symbols (including both generated wild symbols and expanded wild symbols) being displayed in any adjacent related symbol display positions, no wild symbol modification condition is satisfied. In this example, no more wild symbols are expanded and the play of the multi-dimensional symbol game incorporating expanding wild symbols ends. As also seen in FIG. 3E, the gaming system provides appropriate messages such as "THE WILD SYMBOLS HAVE STOPPED EXPANDING" and "GAME OVER" to the player visually, or through suitable audio or audiovisual displays.

Figure 4A:
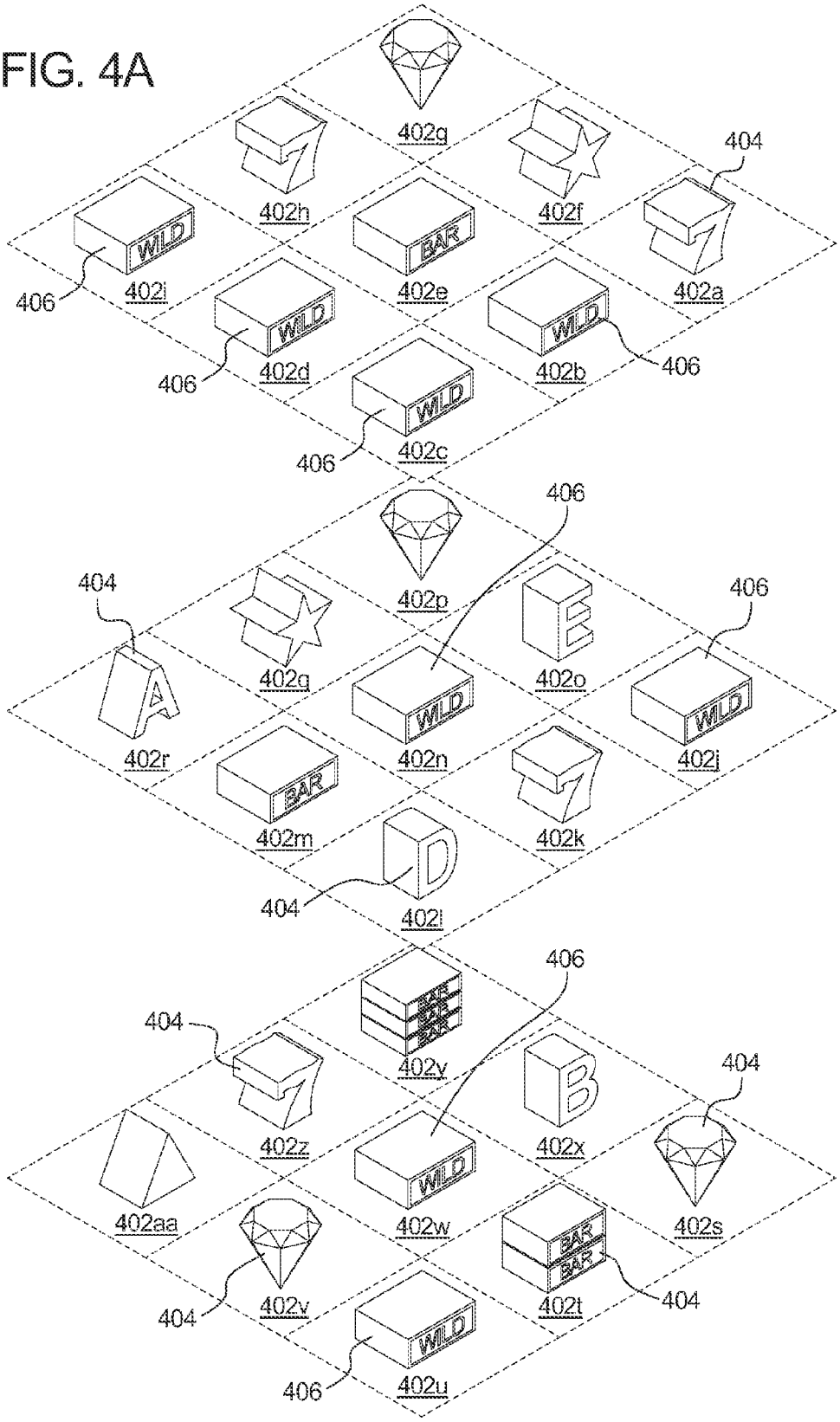
FIG. 4A is a front exploded perspective view of another embodiment of the gaming system disclosed herein illustrating a plurality of symbols generated in a plurality of symbol display positions of a plurality of symbol display position grids at a plurality of different depths.
Figure 4B:
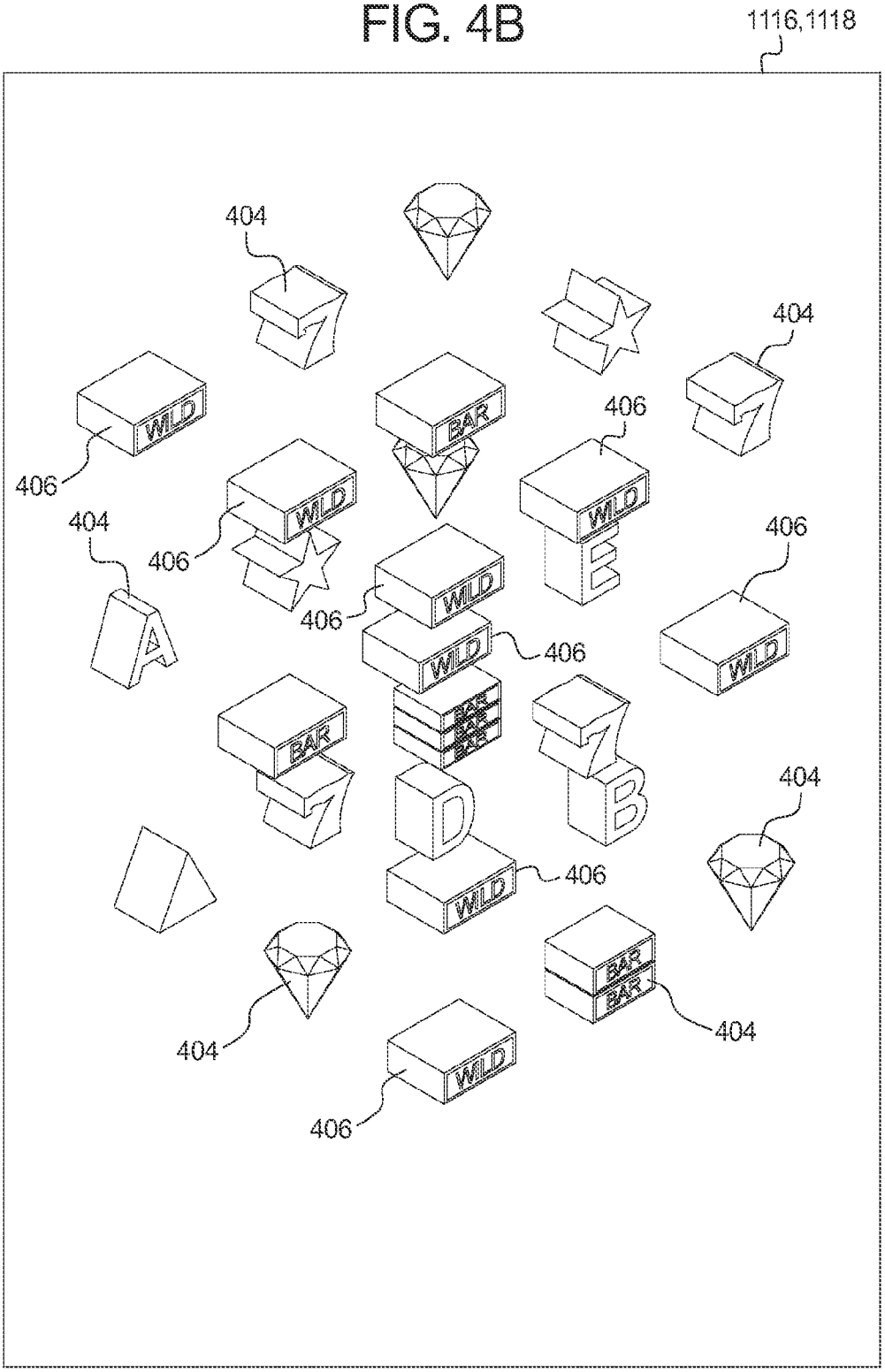
FIGS. 4B, 4C, 4D, 4E and 4F are front views of the embodiment of the gaming system of FIG. 4A illustrating a play of the multi-dimensional symbol game with interpolating wild symbols and extrapolating wild symbols.

In one embodiment, as described above, a wild symbol modification condition is satisfied based on: (i) wild symbols being displayed (either by being generated at or being expanded into) at non-adjacent related symbol display positions, and/or (i) wild symbols being displayed (either by being generated at or being expanded into) at adjacent related symbol display positions. As illustrated in the different views of FIGS. 4A and 4B, in one example embodiment of a play of the multi-dimensional symbol game incorporating expanding wild symbols disclosed herein, the gaming system generates a plurality symbols (including wild symbols 406 and non-wild symbols 404) at a plurality of symbol display positions 402*a* to 402*aa* at each of a plurality of symbol display position grids of different depths.

Figure 4C:
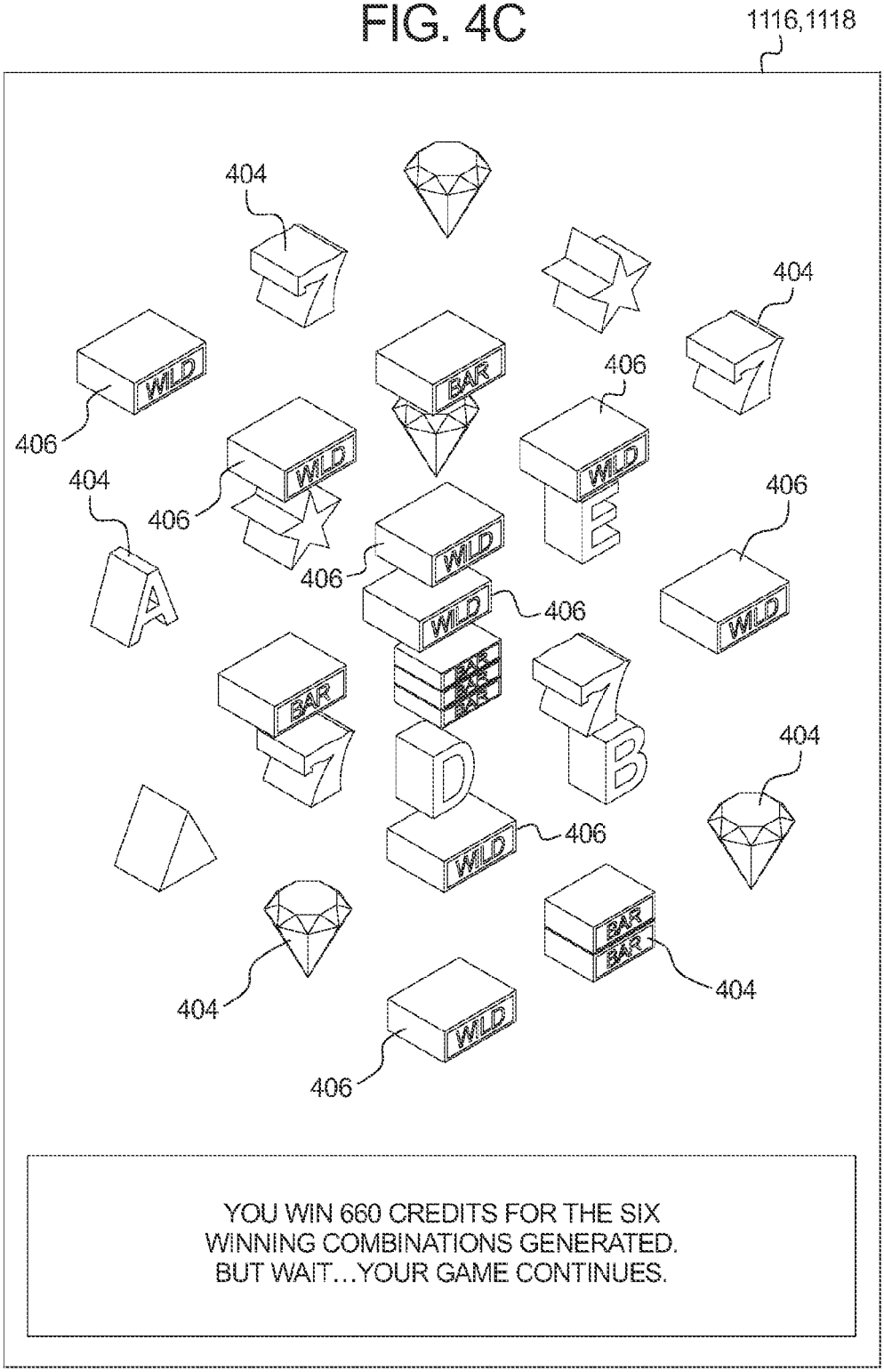
Figure 4D:
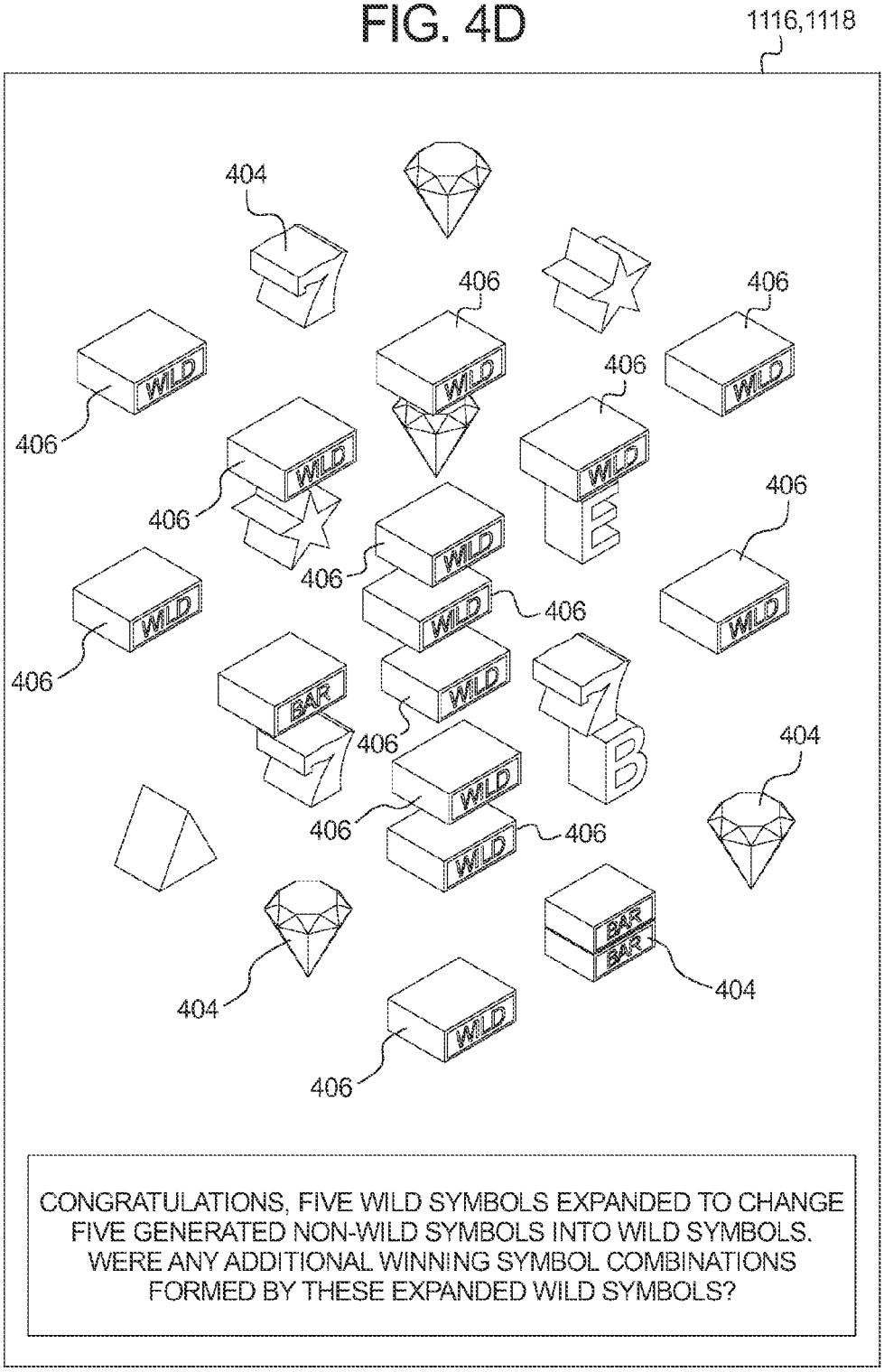

As seen in FIG. 4C, after generating a plurality of symbols, the gaming system determines that, based on each generated wild symbol functioning as or otherwise changing to a different symbol: (i) the displayed symbol combination of wild symbol—wild symbol—wild symbol in symbol display positions 402*c*, 402*d* and 402*i*, respectively, is a winning symbol combination associated with an award of three-hundred credits, (ii) the displayed symbol combination of wild symbol—wild symbol—seven symbol in symbol display positions 402*c*, 402*b* and 402*a*, respectively, is a winning symbol combination associated with an award of one-hundred-fifty credits, (iii) the displayed symbol combination of single bar symbol—wild symbol—wild symbol in symbol display positions 402*e*, 402*n* and 402*w*, respectively, is a winning symbol combination associated with an award of forty credits, (iv) the displayed symbol combination of wild symbol—wild symbol—triple bar symbol in symbol display positions 402*u*, 402*w* and 402*y*, respectively, is a winning symbol combination associated with an award of one-hundred credits, (v) the displayed symbol combination of A symbol—wild symbol—wild symbol in symbol display positions 402*r*, 402*n* and 402*j*, respectively, is a winning symbol combination associated with an award of sixty credits, and (vi) the displayed symbol combination of wild symbol—D symbol—wild symbol in symbol display positions 402*c*, 402*l* and 402*u*, respectively, is a winning symbol combination associated with an award of ten credits. Accordingly, the gaming system provides an award of six-hundred-sixty credits to the player and provides appropriate messages such as "YOU WIN 660 CREDITS FOR THE SIX WINNING COMBINATIONS GENERATED" and "BUT WAIT . . . YOUR GAME CONTINUES" to the player visually, or through suitable audio or audiovisual displays.

It should be appreciated that while this example includes one or more paylines that generally run along and diagonally between the different rows and columns formed by the symbol display positions of the symbol display position grids, one or more paylines running in any suitable direction may be implemented in association with this example. Accordingly, while this example, for ease of illustration, highlights winning symbol combinations located along vertical, horizontal and/or diagonal paylines, any suitable payline running in any suitable direction, including, but not limited to, vertical paylines, horizontal paylines, diagonal paylines, paylines that extend in one or more different directions, paylines that extend through a plurality of symbol display positions of a symbol display position grid at one depth, and/or paylines that extend through a plurality of symbol display positions of a plurality of symbol display position grids at a plurality of different depths may be implemented in association with determining winning symbol combinations of this example and/or any embodiment suitably disclosed herein.

In this example, the gaming system then determines that, based on: (i) certain of the displayed wild symbols being generated in certain non-adjacent related symbol display positions and/or (ii) certain of the generated wild symbols being generated in certain adjacent related symbol display positions, five wild symbol modification conditions are satisfied. Accordingly, as seen in FIG. 40, the gaming system modifies: (i) single bar symbol in symbol display position 402*e* (which is related to adjacent related symbol display positions 402*n* and 402*w* which both include wild symbols 406) into a wild symbol 406, (ii) seven symbol in symbol display position 402*a* (which is related to adjacent related symbol display positions 402*c* and 402*b* which both include wild symbols 406) into a wild symbol 406, (iii) A symbol in symbol display position 402*r* (which is related to adjacent related symbol display positions 402*n* and 402*j* which both include wild symbols 406) into a wild symbol 406, (iv) D symbol in symbol display position 402*l* (which is related to non-adjacent related symbol display positions 402*c* and 402*u* which both include wild symbols 406) into a wild symbol 406, and (v) triple bar symbol in symbol display position 402*y* (which is related to adjacent related symbol display positions 402*u* and 402*w* which both include wild symbols 406) into a wild symbol 406. In this example, the gaming system provides appropriate messages such as "CONGRATULATIONS, FIVE WILD SYMBOLS EXPANDED TO CHANGE FIVE GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

It should be appreciated that while this example includes determining whether zero, one or more wild symbol modification conditions are satisfied based on any wild symbols displayed in any non-adjacent related symbol display positions and/or adjacent related symbol display positions located along the different rows and columns formed by the symbol display positions of the symbol display position grids, any configuration of non-adjacent related symbol display positions and/or adjacent related symbol display positions may be analyzed to determine if any wild symbol modification conditions are satisfied. For example, illustrating one or more diagonal alignments of adjacent related symbol display positions, the gaming system may additionally or alternatively modify, as seen in FIG. 4C, diamond symbol in symbol display position 402*g* (which is related to symbol display position 402*n* and symbol display position 402*u* which both include wild symbols) into a wild symbol. Accordingly, while this example, for ease of illustration, highlights determining if any wild symbol modifications are satisfied based on non-adjacent related symbol display positions and/or adjacent related symbol display positions located along vertically aligned symbol display positions and/or horizontally aligned symbol display positions, any suitable alignment of non-adjacent related symbol display positions and/or adjacent related symbol display positions, including, but not limited to, vertically aligned non-adjacent related symbol display positions and/or vertically aligned adjacent related symbol display positions, horizontally aligned non-adjacent related symbol display positions and/or horizontally aligned adjacent related symbol display positions, diagonally aligned non-adjacent related symbol display positions and/or diagonally aligned adjacent related symbol display positions, non-adjacent related symbol display positions and/or adjacent related symbol display positions extending in one or more different directions, non-adjacent related symbol display positions and/or adjacent related symbol display positions in one symbol display position grid at one depth, and/or non-adjacent related symbol display positions and/or adjacent related symbol display positions in a plurality of symbol display position grids at a plurality of different depths may be implemented in association with determining if any wild symbol modification conditions are satisfied in this example and/or any embodiment suitably disclosed herein.

Figure 4E:
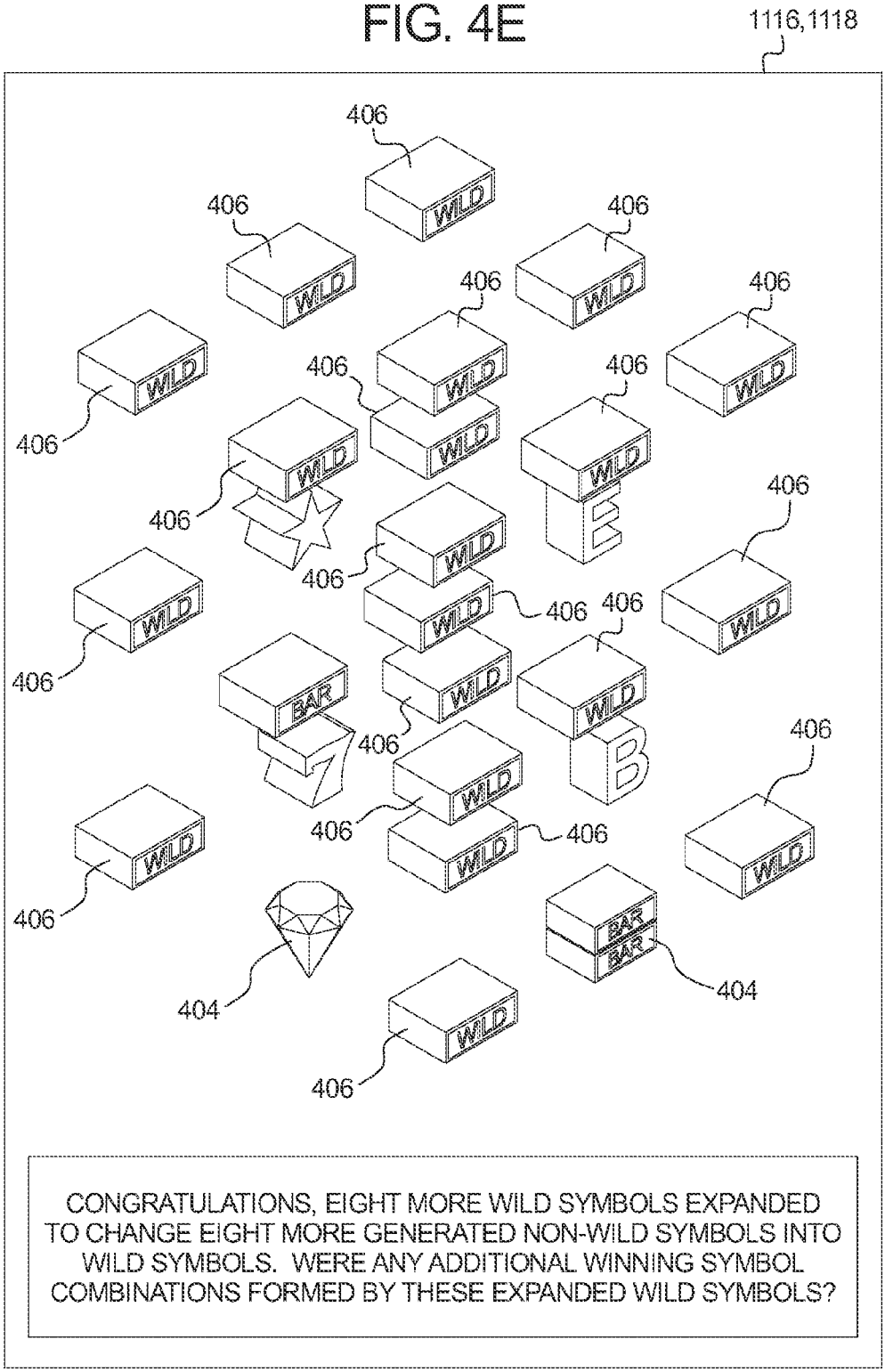

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines if, based on certain of the wild symbols (including both generated wild symbols and expanded wild symbols) being displayed in certain non-adjacent related symbol display positions and/or (ii) certain of the wild symbols (including both generated wild symbols and expanded wild symbols) being displayed in certain adjacent related symbol display positions, eight more wild symbol modification conditions are satisfied. Accordingly, as seen in FIG. 4E, the gaming system modifies: (i) seven symbol in symbol display position 402*h* (which is related to adjacent related symbol display positions 402*e* and 402*b* which now both include wild symbols 406) into a wild symbol 406, (ii) diamond symbol in symbol display position 402*g* (which is related to adjacent related symbol display positions 402*c* and 402*e* which now both include wild symbols 406) into a wild symbol 406, (iii) star symbol in symbol display position 402*f* (which is related to adjacent related symbol display positions 402*e* and 402*e* which now both include wild symbols 406) into a wild symbol 406, (iv) diamond symbol in symbol display position 402*p* (which is related to adjacent related symbol display positions 402*l* and 402*n* which now both include wild symbols 406) into a wild symbol 406, (v) single bar symbol in symbol display position 402*m* (which is related to non-adjacent related symbol display positions 402*l* and 402*r* which now both include wild symbols 406) into a wild symbol 406, (vi) seven symbol in symbol display position 402*k* (which is related to non-adjacent related symbol display positions 402*l* and 402*j* which both include wild symbols 406) into a wild symbol 406, (vii) triangle symbol in symbol display position 402*aa* (which is related to adjacent related symbol display positions 402*i* and 402*r* which now both include wild symbols 406) into a wild symbol 406, and (viii) diamond symbol in symbol display position 402*s* (which is related to adjacent related symbol display positions 402*a* and 402*j* which now both include wild symbols 406) into a wild symbol 406. In this example, the gaming system provides appropriate messages such as "CONGRATULATIONS, EIGHT MORE WILD SYMBOLS EXPANDED TO CHANGE EIGHT MORE GENERATED NON-WILD SYMBOLS INTO WILD SYMBOLS" and "WERE ANY ADDITIONAL WINNING SYMBOL COMBINATIONS FORMED BY THESE EXPANDED WILD SYMBOLS?" to the player visually, or through suitable audio or audiovisual displays.

Figure 4F:
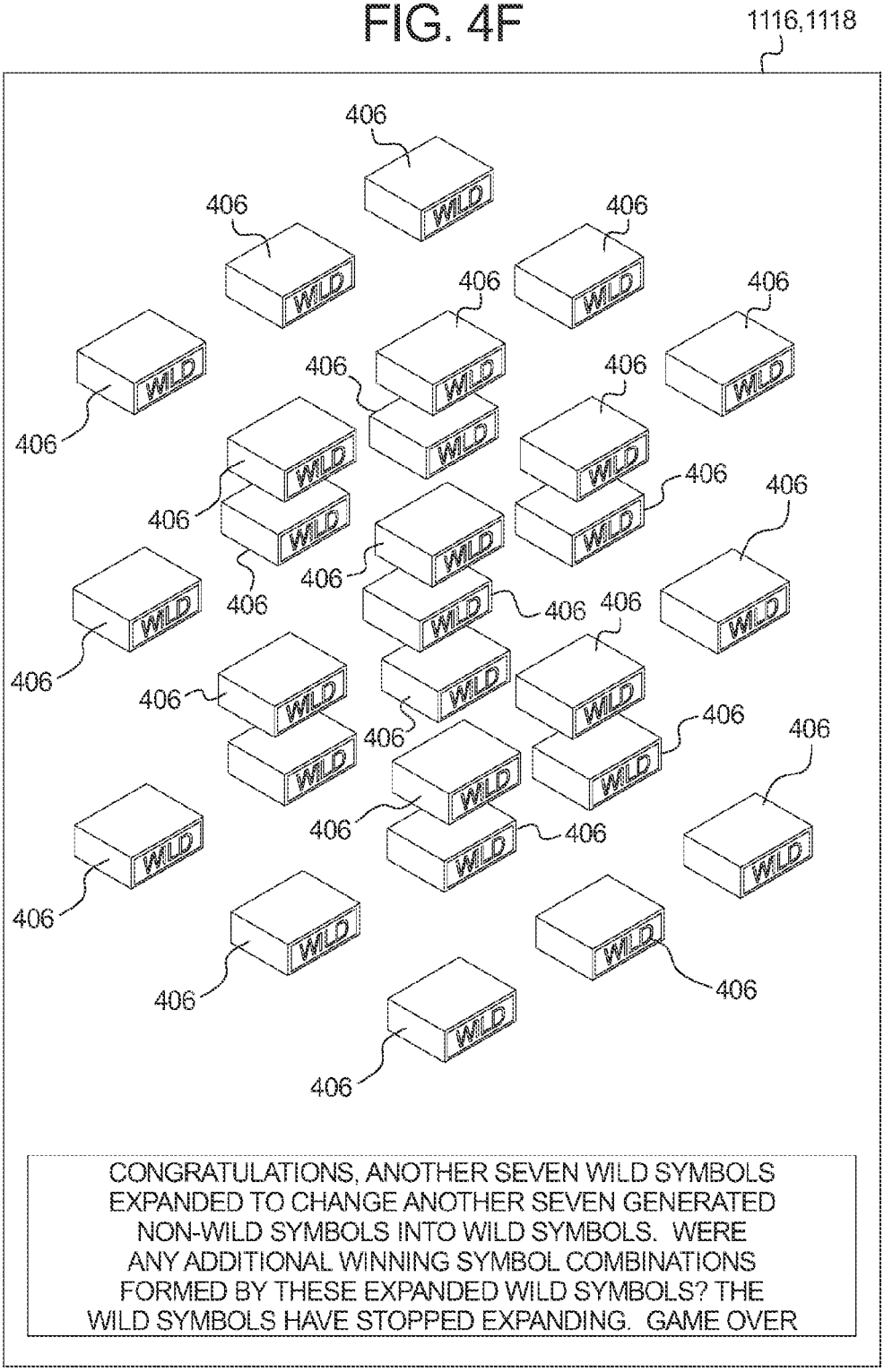

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that, based on certain of the displayed wild symbols (including both generated wild symbols and expanded wild symbols) being displayed in certain non-adjacent related symbol display positions and/or certain adjacent related symbol display positions, seven wild symbol modification conditions are satisfied. Accordingly, as seen in FIG. 4F, since each of the remaining non-wild symbols is: (A) in a symbol display position which is related to adjacent related symbol display positions which now both include wild symbols, and/or (B) in a symbol display position which is related to non-adjacent related symbol display positions which now both include wild symbols, the gaming system modifies each of the remaining non-wild symbols into a wild symbol. In this example, the gaming system provides appropriate messages such as "CONGRATULATIONS, ANOTHER SEVEN WILD SYMBOLS EXPANDED TO CHANGE ANOTHER SEVEN GENERATED NON-WILD SYMBOLS INTO WILD SYMBOLS", and "WERE ANY ADDITIONAL WINNING SYMBOL COMBINATIONS FORMED BY THESE EXPANDED WILD SYMBOLS?" to the player visually, or through suitable audio or audiovisual displays.

Following this modification of non-wild symbols into wild symbols, the gaming system determining, based on each generated or modified wild symbol functioning as or otherwise changing to a different symbol, any awards associated with the currently displayed symbols and the gaming system providing any determined awards to the player (not shown), the gaming system determines that since each of the symbol display positions currently display a wild symbol, no more wild symbol modification conditions may be satisfied. In this example, based on the inability to satisfy the wild symbol modification condition, the play of the multi-dimensional symbol game incorporating expanding wild symbols ends. In this example, as seen in FIG. 4F, the gaming system provides appropriate messages such as "THE WILD SYMBOLS HAVE STOPPED EXPANDING" and "GAME OVER" to the player visually, or through suitable audio or audiovisual displays.

In one embodiment, if the gaming system causes each of the symbols in each of the symbol display positions to be modified into wild symbols, the gaming system provides one or more designated awards to the player, such as a progressive award or a triggering of a bonus game. In another embodiment, if the gaming system causes each of the symbols in each of the symbol display positions to be modified into wild symbols, the gaming system triggers one or more features for one or more plays of one or more games.

In another embodiment, if the gaming system determines that, when accounting for each generated or modified wild symbol functioning as or otherwise changing to a different symbol, at least two multi-dimensional paylines (i.e., paylines that run through different symbol display positions in different symbol display position grids of different depths) each include a winning symbol combination, the gaming system provides a designated award or triggers one or more features for one or more plays of one or more games. For example, if the gaming system determines that two multi-dimensional paylines each include a winning symbol combination, the gaming system triggers a 2× modifier for any awards for the next designated quantity of symbol generations. In this example, For example, if the gaming system determines that three multi-dimensional paylines each include a winning symbol combination, the gaming system triggers a 3× modifier for any awards for the next designated quantity of symbol generations.

In another embodiment, each symbol of the plurality of symbols is associated with a characteristic, such as a color or shape. In one such embodiment employing characteristics, the gaming system utilizes the characteristics of the symbols to convey information to the player. For example, a designated characteristic, such as the color gold, is associated with wild symbols, wherein the gaming system displays to the player that each of the symbols of a symbol display position grid are gold and therefore, the symbols of this symbol display grid are each generated wild symbols or expanded wild symbols. In another such embodiment employing characteristics, the gaming system utilizes the characteristics of the symbols to provide to the player one or more awards, such as one or more matching characteristic awards. In this embodiment, different characteristics are associated with different awards, such that the award provided to the player is based on which characteristic is matched. For example, if a plurality of the displayed symbols generated at a plurality of the symbol display positions of one or more of the symbol display position grids are each associated with the same characteristic, such as the same color silver, the gaming system provides to the player the matching characteristic award associated with that characteristic.

In another embodiment, the multi-dimensional expanding wild symbols game disclosed herein utilizes the fourth dimension of time to determine any awards to be provided to a player. In one such embodiment, the gaming system associates certain symbols with a duration or quantity which those symbols remain in one of the symbol display grids. In this embodiment, if such symbols are generated in the symbol display positions of the symbol display position grids and such symbols form part of a winning symbol combination, then as long as the associated duration or quantity has not expired, such symbols are not modified or otherwise removed from the symbol display positions of the symbol display position grids.

In another embodiment, the gaming system tracks a quantity of times a designated symbol is included in one or more winning symbol combinations. In this embodiment, if the quantity of times the designated symbol is included in one or more winning symbol combinations reaches a designated quantity, an additional award is provided to the player. For example, if a designated symbol was previously included in four separate winning symbol combinations (for a single play of a game) and that designated symbol is included in a fifth winning symbol combination (for the single play of the game), the gaming system triggers a bonus round in association with this designated symbol.

In another embodiment utilizing the fourth dimension of time to determine any awards to be provided to a player, the gaming system records or stores one or more of the symbols generated in one or more of symbol display positions of one or more of the symbol display position grids for one or more plays of the game. In one such embodiment, the gaming system records or stores, for an individual gaming device, the symbols generated in the symbol display positions of the symbol display position grids for each play of the game. In another such embodiment, the gaming system records or stores, for a group of gaming devices, the symbols generated in the symbol display positions of the symbol display position grids for each play of the game. In another such embodiment, the gaming system records or stores, for an individual player, the symbols generated in the symbol display positions of the symbol display position grids for each play of the game. In another such embodiment, the gaming system records or stores, for a group of players, the symbols generated in the symbol display positions of the symbol display position grids for each play of the game.

In one embodiment, when a player initiates a play of this multi-dimensional expanding wild symbols game, the gaming system randomly picks a designated quantity of one or more previous plays of the game and uses the previously recorded symbols of those plays of the game to determine any awards for the initiated play of the game. In another embodiment, when a player initiates a play of this multi-dimensional expanding wild symbols game, the gaming system picks a designated quantity of one or more previous plays of the game from a designated period of time and uses the previously recorded symbols of those plays of the game to determine any awards for the initiated play of the game.

In this embodiment, for a play of a game, in addition to or as an alternative to evaluating the displayed symbols generated at the symbol display positions of one or more symbol display position grids, the gaming system evaluates the displayed symbols generated at the symbol display positions of one or more symbol display position grids compared to the stored symbols generated in the symbol display positions of the symbol display position grids for one or more previous plays of the game. In one such embodiment, the gaming system determines an award based on how many displayed symbols generated at the symbol display positions of one or more symbol display position grids were also displayed at the symbol display positions of one or more symbol display position grids for one or more previous plays of the game. In another such embodiment, the gaming system determines an award based on which symbols were generated and displayed in both the current play of the game and one or more previous plays of the game. In another such embodiment, the gaming system determines an award based on which symbols were generated and displayed in which symbol display positions of which symbol display position grids in both the current play of the game and one or more previous plays of the game. In another such embodiment, the gaming system determines an award based on which symbols were generated and displayed in a current play of the game compared to the outcome that another player (or other players) previously generated in one or more previous or concurrent plays of the game.

In one embodiment, the gaming system enables the player to win an additional award depending on how the symbols generated for that player compare to the symbols generated for a subsequent play of the game. For example, the gaming system provides the player an award if the symbols generated for that player compare favorable with the symbols generated for another play of the game. That is, this embodiment of the gaming system provides that the symbols generated for a player are utilized in at least two games, once as an active symbols for the current play of the game and once as an inactive or comparison symbols for one or more subsequent plays of the game In another embodiment, when the gaming system is initially started, the gaming system does not have the available data of stored symbols from previous plays of the game (because no symbols have been generated in any plays of the game yet). In this embodiment, one or more default bots are used to build an applicable database of symbols generated in plays of the game. As the database becomes more extensive with stored symbols from actual plays of the game, the gaming system relies more on the previous plays of the game and less on the default bats.

In another embodiment, the gaming system determines whether the symbols displayed at the symbol display positions of the symbol display position grids of different depths form any scatter pays. In one such embodiment, one or more scatter pay combinations include symbols displayed in specific symbol display positions. For example, to trigger a winning scatter pay, the gaming system determines if a designated scatter symbol is in a designated symbol display position of a designated symbol display position grid, such as symbol display position 202*n* of FIG. 2A. In this example, the gaming system provides different payouts based on the type of symbols and quantity of symbols which form the scatter pay winning combination.

In another embodiment, the gaming system determines an award based on which symbols were generated and displayed in a current play of the game compared to a target outcome, such as a predefined target image formed by the plurality of symbols. In another embodiment, the gaming system determines an award based on a plurality of players each contributing one or more symbols to match a target outcome.

In another embodiment, the gaming system utilizes an accumulator cube to provide one or more awards over a period of time. In one such embodiment, if a symbol from a player's play of a game matches a target symbol in an exact position in a target accumulator cube, the gaming system adds that symbol to an accumulator cube. In this embodiment, when the accumulator cube is filled with symbols (either all from an individual player over a plurality of plays of the game or from a group of a plurality of players over a plurality of plays of the game), the gaming system provides an award to one or more players, such as providing each player an award value or enabling each player to participate in a bonus game.

In one embodiment, the symbols available to be generated in association with each of the symbol display position grids are the same. In this embodiment, each of the symbols generated at each of the symbol display positions of each of the symbol display position grids are selected from the same plurality of symbols. For example, for a 3×5 reel game, the gaming system utilizes the same reel strips to create ten or more symbol display position grids.

In another embodiment, different symbols are available to be generated in association with different symbol display position grids. In this embodiment, a plurality of the symbols available to be generated in a plurality the symbol display positions of at least one of the symbol display position grids are selected from one plurality of symbols and a plurality of the symbols available to be generated in a plurality of the symbol display positions of at least a different one of the symbol display position grids are selected from a different plurality of symbols. For example, the plurality of symbols available to be generated in association with the symbol display positions of one symbol display position grid at one depth includes a higher concentration of wild symbols and/or high valued symbols. In another example, the plurality of symbols available to be generated in association with the symbol display positions of a second symbol display position grid at a second depth includes a higher concentration of symbols associated with the triggering of a bonus game.

In another embodiment, the symbols available to be generated with each symbol display position grid vary between plays of the game. For example, for a first play of the game, the plurality of symbols available to be generated in association with the symbol display positions of a third symbol display position grid at a third depth include a higher concentration of wild symbols, while for a second play of the game, the plurality of symbols available to be generated in association with the symbol display positions of a second symbol display position grid at a second depth include a higher concentration of wild symbols. In another example, for a first play of the game, the plurality of symbols available to be generated in association with the symbol display positions of a third symbol display position grid at a third depth include a higher concentration of bonus triggering symbols, while for a second play of the game, the plurality of symbols available to be generated in association with the symbol display positions of a first symbol display position grid at a first depth include a higher concentration of wild symbols.

In another embodiment of employing different symbols in association with different symbol display position grids, the gaming system creates ten or more layers (i.e., ten or more symbol display position grids) from reel strips of various average expected payback percentages. For example, the average expected payback percentage of the reel strips is 95%, but one or more average expected payback percentages of one or more reel strips are higher than 100%. In this example, the gaming system randomly arranges the reel strips with the created symbol display position grids such that the player could receive any of the reel strips in association with any of the symbol display position grids. Accordingly, based on which reel strip is randomly associated with which symbol display position grid (and thus based on which symbols are likely to be generated in symbol display positions initially displayed to the player) the play of the game may be associated with a greater than 100% average expected payback percentage or associated with an average expected payback percentage of less than 100%. In different embodiments, the varying average expected payback percentages of various symbol display position grids is accomplished through using one or more wild symbols, one or more multiplier wild symbols, one or more top award symbols, one or more progressive jackpot symbols, one or more bonus symbols, and/or one or more split symbols.

In another embodiment, the gaming system adds additional symbol display position grids of different depths as the game progresses. In another embodiment, the gaming system adds additional symbol display positions to existing symbol display position grids as the game progresses.

In another embodiment, the size and/or configuration of the symbol display position grids at one or more different depths are different to cause the collection of symbol display position grids to form one or more non-rectangular shapes. In one such embodiment, one or more symbol display position grids include different quantities of rows and/or columns of symbol display position such that one or more symbol display position grids appear to include arms and/or legs of symbol display positions. In another embodiment, the size and/or configuration of the symbol display position grids at one or more different depths are different. For example, a first symbol display position grid of a first depth includes three rows and five columns of symbol display positions and a second symbol display position grid of a second depth includes four rows and five columns of symbol display positions. In another embodiment, the number of symbol display positions of a plurality of symbol display position grids of different depths are different. For example, a first symbol display position grid of a first depth includes a first number of one or more symbol display positions and a second symbol display position grid of a second depth includes a second number of one or more symbol display positions. In another example, one symbol display position grid of a first depth includes a plurality of symbol display positions and another symbol display position grid of a second depth includes one symbol display position.

In another embodiment, one or more symbols are not initially generated at one or more symbol display position grids (i.e., one or more symbol display position grids include one or more initially empty symbol display positions). In this embodiment, when a first symbol display position grid including at least one initially empty symbol display position is placed in front of (relative to the player's line of sight) a second symbol display position grid, symbols from the second symbol display position grid automatically fill in or are otherwise displayed through the empty symbol display positions. Accordingly, the gaming system provides a player access to symbols from deeper symbol display position grids due to such initially empty symbol display positions. It should be appreciated that in these embodiments, one or more symbols generated in a plurality of different symbol display position grids at different depths will be initially displayed to the player.

In one embodiment, as described above, prior to the play of the multi-dimensional expanding wild symbols game, the gaming system displays one or more of the symbol display positions grids. In another embodiment, prior to the play of the multi-dimensional expanding wild symbols game, the gaming system covers or masks one or more of the symbol display positions grids. In one such embodiment, the gaming system displays the plurality of symbol display position grids in a box or cube which includes a plurality of compartments (corresponding to the symbol display positions). In this embodiment, upon the initiation of the play of the multi-dimensional expanding wild symbols game, the gaming system removes or uncovers the box to display the plurality of symbol display positions of the plurality of symbol display position grids.

In another embodiment, the gaming system utilizes a plurality of different sets of symbol display position grids of different depths. In one such embodiment, at least a first area, column or row of a first set of symbol display position grids is associated with or linked to at least a first area, column or row of a second set of symbol display position grids and at least a second area, column or row of the first set of symbol display position grids is not associated with or linked to any area, column or row in any second set of symbol display position grids. In a play of the game, as described above, symbols are independently generated for each set of symbol display position grids and the symbols displayed for each set of symbol display position grids of different depths are independently evaluated to provide any awards for any winning symbols or winning symbol combinations. In one embodiment, if any empty symbol display positions are formed on the first area, column or row of the first set of symbol display position grids, the gaming system shifts or transfers one or more symbols from the first area, column or row of the first set of symbol display position grids to the linked first area, column or row of the second set of symbol display position grids to occupy the one or more empty symbol display positions. In this embodiment, if there are any empty symbol display positions on the second area, column or row of the first set of symbol display position grids, the gaming system does not shift or transfer any symbols from the second area, column or row of the first set of symbol display position grids to the second area, column or row of the second set of symbol display position grids. The gaming system then independently evaluates the symbols displayed for each set of symbol display position grids to provide any awards for any winning symbols or winning symbol combinations.

In another embodiment, the gaming system implements the multiple dimension expanding wild symbols game as a tumbling reels game. In this embodiment, the gaming system evaluates the symbols currently displayed to the player (i.e., evaluates symbols generated in symbol display positions of at least two different symbol display position grids of different depths), removes any symbols of any displayed winning symbol combinations, generates zero, one or more replacements for any removed symbols and repeats this process until no more displayed winning symbol combinations exist. In a related embodiment, the gaming system causes the remaining symbols to "fall" into any gaps left by such removed symbols, where possible, prior to generating replacement symbols. In different such embodiments, the direction in which symbols fall, or the behavior of the falling, may be determined by the player and/or the gaming system and/or may be dependent upon the current orientation of the symbol display position grids. In another such embodiment, the gaming system expands zero, one or more wild symbols (as described above) prior to the removal of any symbols of any winning symbol combinations. In another such embodiment, the gaming system expands zero, one or more wild symbols (as described above) after the removal of any symbols of any winning symbol combinations.

In another embodiment of employing different symbols in association with different symbol display position grids, the gaming system layers the symbol display position grids with symbols in order of payback percentage. For example, the top layer (i.e., the first symbol display position grid including generated symbols initially displayed to the player) may be created from reel strips having an 85% average expected payback percentage, the next layer (i.e., the second symbol display position grid including generated symbols not initially displayed to the player) may be created from reel strips having a 110% average expected payback percentage, the next layer (i.e., the third symbol display position grid including generated symbols not initially displayed to the player) may be created from reel strips having a 250% average expected payback percentage, and the next layer (i.e., the fourth symbol display position grid including generated symbols not initially displayed to the player) may be created from reel strips having a 1000% average expected payback percentage. In this example, the more winning combinations a player removes from the top layer, the more likely the player is to experience the higher valued awards associated with the later or deeper layers.

In one embodiment, the gaming system provides a group gaming aspect to the multiple dimension expanding wild symbols game disclosed herein. In one such embodiment, the multiple dimension expanding wild symbols game is a cooperative community game wherein a plurality of players cooperate or play together to win one or more awards. In another such embodiment, the multiple dimension expanding wild symbols game is a competition community game wherein a plurality of players compete or player against each other to win one or more awards.

In different embodiments, if the gaming system provides the player one or more awards in association with any winning symbol combination and/or wild symbols expanding into each of the available symbol display positions, the gaming system selects such awards from the group of awards including, but not limited to:

(i) a modification of an amount of credits of a credit balance;
(ii) a modification of an amount of promotional credits;
(iii) a modification of a placed wager amount;
(iv) a modification of a wager amount available to be placed;
(v) a modification of a placed side wager amount;
(vi) a modification of a side wager amount available to be placed;
(vii) a modification of a number of wagered on paylines;
(viii) a modification of a number of paylines available to be wagered on;
(ix) a modification of a wager placed on one or more paylines (or on one or more designated paylines);
(x) a modification of a number of ways to win wagered on;
(xi) a modification of a number of available ways to win to be wagered on;
(xii) a modification of a wager placed on one or more ways to win (or on one or more designated ways to win);
(xiii) a modification of a paytable utilized for a play of a game;
(xiv) a modification of an average expected payback percentage of a play of a game;
(xv) a modification of one or more awards available;
(xvi) a modification of a range of awards available;
(xvii) a modification of a type of awards available;
(xviii) a modification of one or more progressive awards;
(xix) a modification of one or more modifiers, such as multipliers, available;
(xx) a modification of an activation of a reel (or a designated reel);
(xxi) a modification of an activation of a plurality of reels;
(xxii) a modification of a generated outcome (or a designated generated outcome);
(xxiii) a modification of a generated outcome (or a designated generated outcome) associated with an award over a designated value;
(xxiv) a modification of a generated outcome (or a designated generated outcome) on a designated payline;
(xxv) a modification of a generated outcome (or a designated generated outcome) in a scatter configuration;
(xxvi) a modification of a winning way to win (or a designated winning way to win);
(xxvii) a modification of a designated symbol or symbol combination;
(xxviii) a modification of a generation of a designated symbol or symbol combination on a designated payline;
(xxix) a modification of a generation of a designated symbol or symbol combination in a scatter configuration;
(xxx) a modification of a triggering event of a play of a secondary or bonus game;
(xxxi) a modification of an activation of a secondary or bonus display (such as an award generator);
(xxxii) a modification of an activation of a community award generator;
(xxxiii) a modification of a generated outcome (or a designated generated outcome) in a secondary game;
(xxxiv) a modification of an amount of free spins provided;
(xxxv) a modification of a game terminating or ending condition;
(xxxvi) a modification of how one or more aspects of one or more games (e.g., colors, speeds, sound) are displayed to a player;
(xxxvii) a modification of any game play feature associated with any play of any game disclosed herein;
(xxxviii) a play of any suitable slot game;
(xxxix) a play of any suitable free spins or free game activations;
(xl) a play of any suitable wheel game;
(xli) a play of any suitable card game;
(xlii) a play of any suitable offer and acceptance game;
(xliii) a play of any suitable award ladder game;
(xliv) a play of any suitable puzzle-type game;
(xlv) a play of any suitable persistence game;
(xlvi) a play of any suitable selection game;
(xlvii) a play of any suitable cascading symbols game;
(xlviii) a play of any suitable ways to win game;
(xlix) a play of any suitable scatter pay game;
(l) a play of any suitable coin-pusher game;
(li) a play of any suitable elimination game;
(lii) a play of any suitable stacked wilds game;
(liii) a play of any suitable trail game;
(liv) a play of any suitable bingo game;
(lv) a play of any suitable video scratch-off game;
(lvi) a play of any suitable pick-until-complete game;
(lvii) a play of any suitable shooting simulation game;
(lviii) a play of any suitable racing game;
(lix) a play of any suitable promotional game;
(lx) a play of any suitable high-low game;
(lxi) a play of any suitable lottery game;
(lxii) a play of any suitable number selection game;
(lxiii) a play of any suitable dice game;
(lxiv) a play of any suitable skill game;
(lxv) a play of any suitable auction game;
(lxvi) a play of any suitable reverse-auction game;
(lxvii) a play of any suitable group game: and/or
(lxviii) a play of any other suitable type of game.

In one embodiment, the gaming system causes at least one display device of the player's gaming device to display the multiple dimension expanding wild symbols game. In another embodiment, in addition or in alternative to each gaming device displaying the multiple dimension expanding wild symbols game, the gaming system causes one or more community or overhead display devices to display part or all of the multiple dimension expanding wild symbols game to one or more other players or bystanders either at a gaming establishment or viewing over a network, such as the internet. In another embodiment, in addition or in alternative to each gaming device displaying the multiple dimension expanding wild symbols game, the gaming system causes one or more internet sites to each display the multiple dimension expanding wild symbols game such that a player is enabled to log on from a personal web browser. In another such embodiment, the gaming system enables the player to play one or more primary games on one device while viewing the multiple dimension expanding wild symbols game from another device. For example, the gaming system enables the player to play one or more primary games on a mobile phone while viewing the status of the multiple dimension expanding wild symbols game on a desktop or laptop computer.

In another embodiment, as mentioned above, a multiple dimension expanding wild symbols game triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes a multiple dimension expanding wild symbols game triggering event to occur.

In another embodiment, as also mentioned above, the gaming system does not provide any apparent reasons to the players for a multiple dimension expanding wild symbols game triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one such embodiment, a multiple dimension expanding wild symbols game triggering event occurs based on an amount of coin-in. In this embodiment, the gaming system determines if an amount of coin-in reaches or exceeds a designated amount of coin-in a threshold coin-in amount). Upon the amount of coin-in wagered reaching or exceeding the threshold coin-in amount, the gaming system causes one or more of such events or conditions to occur. In another such embodiment, a multiple dimension expanding wild symbols game triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a multiple dimension expanding wild symbols game triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a multiple dimension expanding wild symbols game triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, a multiple dimension expanding wild symbols game triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, a multiple dimension expanding wild symbols game triggering event occurs based on a quantity of games played. In this embodiment, a quantity of games played is set for when one or more of such events or conditions will occur. In one embodiment, such a set quantity of games played is based on historic data.

In another alternative embodiment, a multiple dimension expanding wild symbols game triggering event occurs based on time. In this embodiment, a time is set for when one or more of such events or conditions will occur. In one embodiment, such a set time is based on historic data.

In another alternative embodiment, a multiple dimension expanding wild symbols game triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, a multiple dimension expanding wild symbols game triggering event occurs based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, a multiple dimension expanding wild symbols game triggering event occurs based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur.

It should be appreciated that any suitable manner of causing a multiple dimension expanding wild symbols game triggering event to occur may be implemented in accordance with the gaming system and method disclosed herein. It should be further appreciated that any of the above-described multiple dimension expanding wild symbols game triggering events may be combined in one or more different embodiments.

It should be appreciated that in different embodiments, one or more of:

i. a quantity of symbol display position grids;
ii. a quantity of symbol display positions in each symbol display position grid;
iii. a shape or configuration of each symbol display position grid;
iv. a quantity of rows in each symbol display position grid;
v. a quantity of columns in each symbol display position grid;
vi. which displayed symbols are evaluated to determine any awards;
vii. which symbols are available to be generated in each symbol display position grid;
viii. a quantity of wild symbols generated when a game is initiated;
ix. which symbol display positions which wild symbols are generated at;
x. which function(s) each wild symbol will employ;
xi. a quantity of wild symbols generated at symbol display positions;
xii. which symbol combinations form winning symbol combinations;
xiii. which awards are associated with which formed winning symbol combinations;
xiv. a quantity of winning symbols combinations which a designated symbol will remain at one of the symbol display positions of one of the symbol display position grids;
xv. which symbols are associated with which characteristics;
xvi. a quantity of stored symbols utilized to compare the generated symbols from a current play of the game to determine any awards for the player;
xvii. which stored symbols from which previous plays of the game are utilized to compare the generated symbols from the current play of the game to determine any awards for the player; and
xviii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
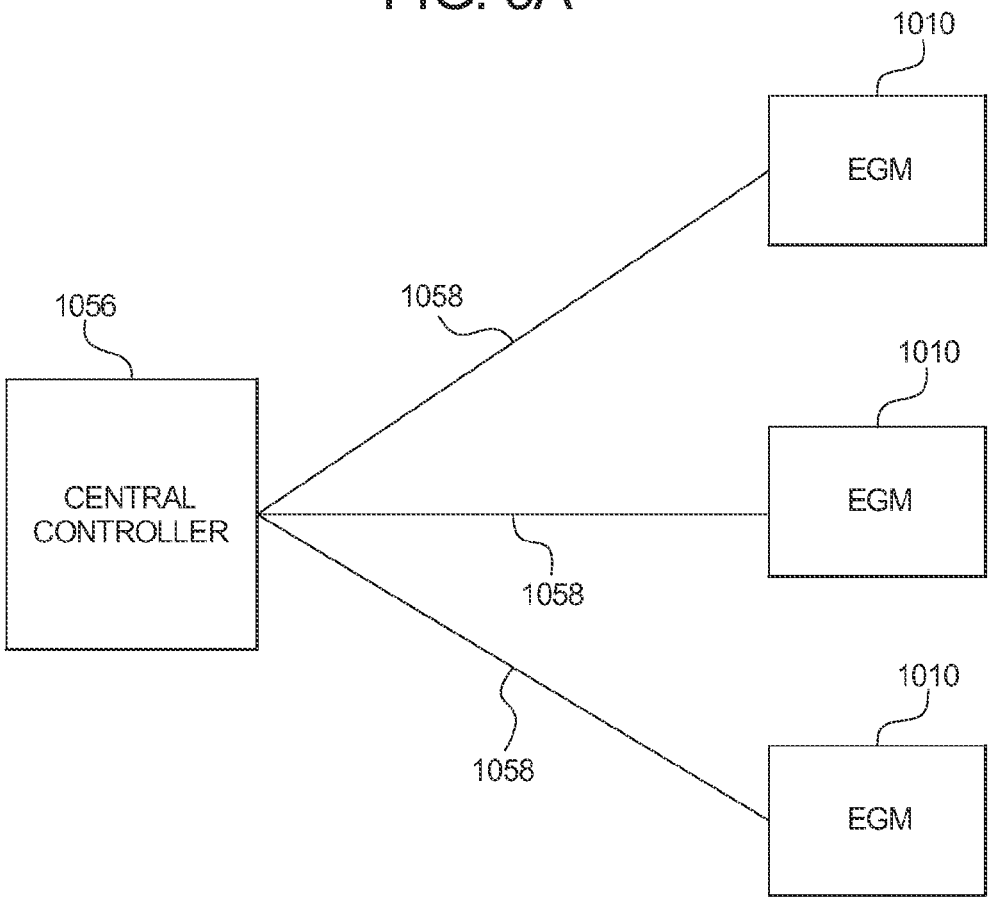
FIG. 5A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network: and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
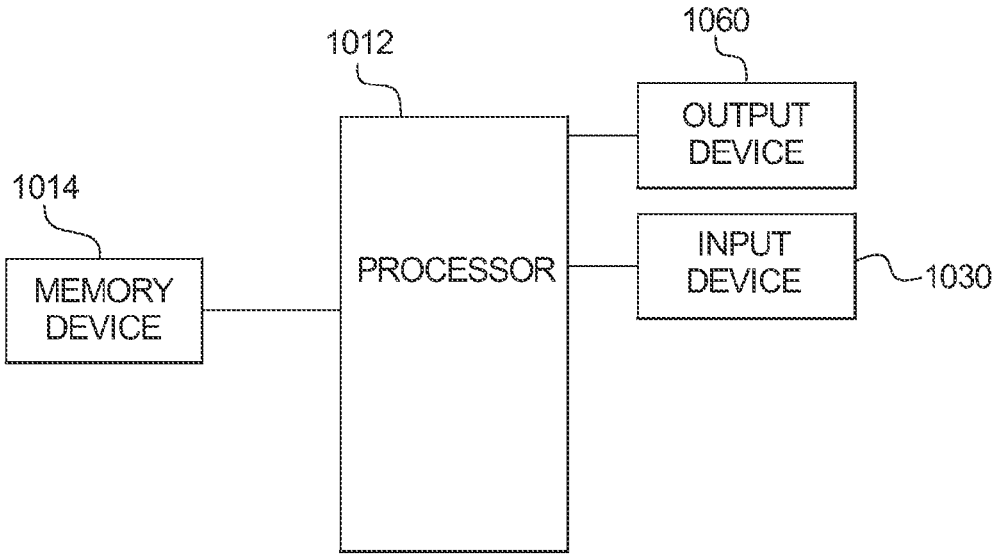
FIG. 5B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
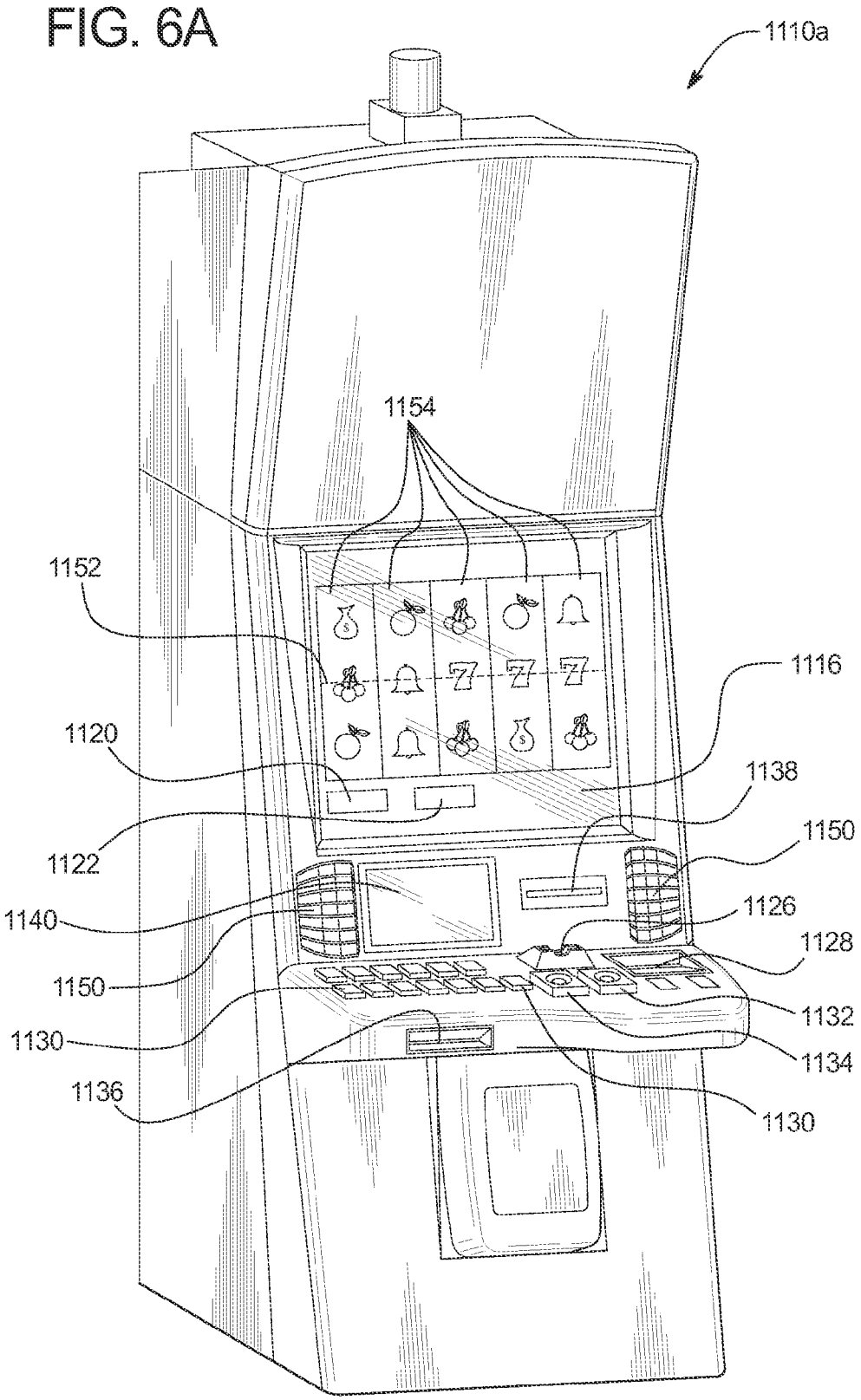
FIGS. 6A and 6B are perspective views of example alternative embodiments of the gaming system disclosed herein.
Figure 6B:
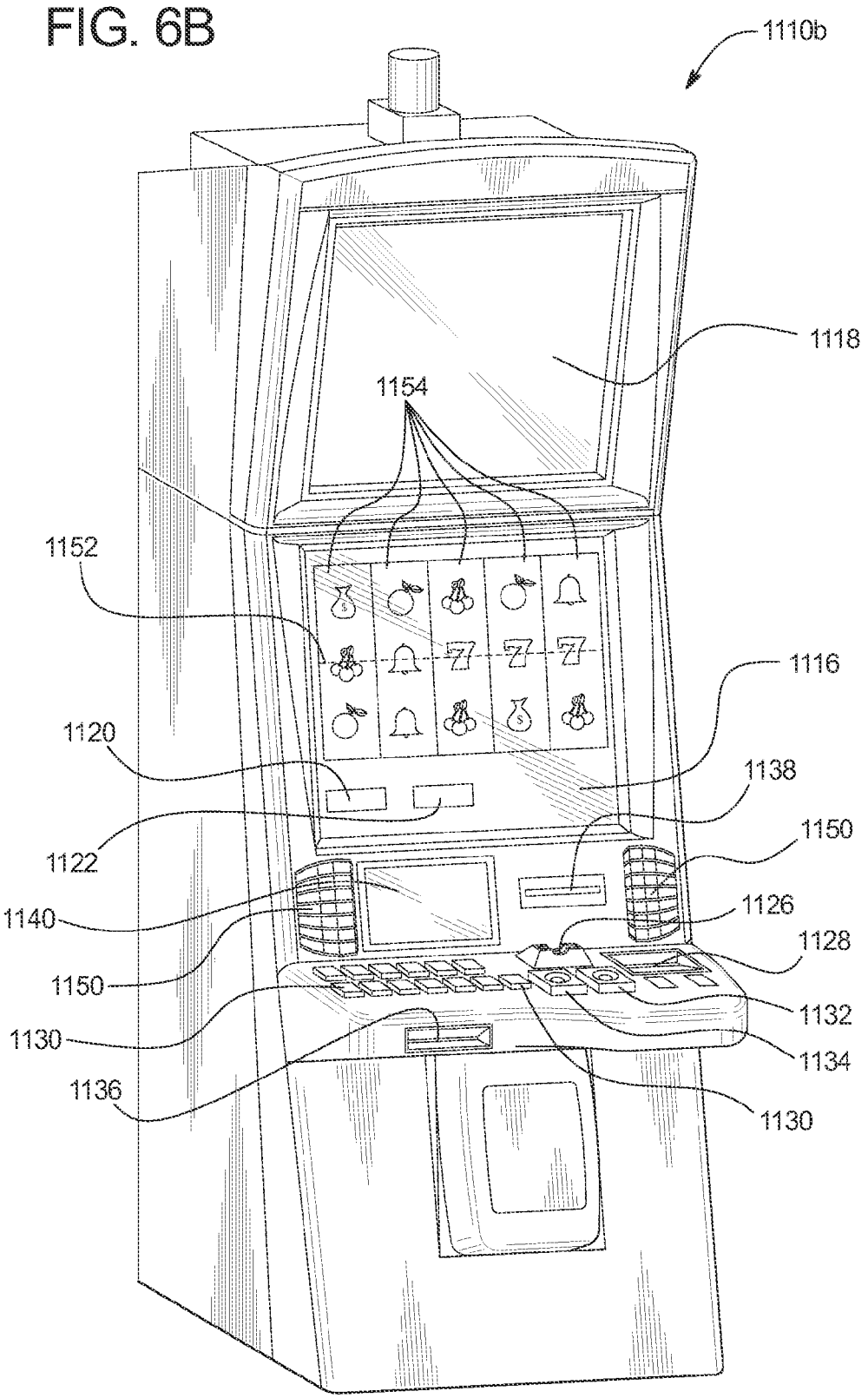

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (a) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 6A and 6B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 200810132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585.223; 7,651,392; 7,666,093; 7,780,523; and 7,905,778 and U.S. Patent Application Publication Nos. 2008/0020846, 2009/0123364, 200910123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including an acceptor, and a cashout device;

at least one display device supported by the housing;

at least one processor; and at least one memory device which stores a plurality of instructions, which when executed by the at least one processor, causes the at least one processor to:

(a) responsive to a physical item being received via the acceptor, establish a credit balance based, at least in part, on a monetary value associated with the received physical item, (b) cause the at least one display device to display one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(c) determine if any of the displayed symbols form any winning symbol combinations;

(d) responsive to a plurality of the displayed symbols forming at least one winning symbol combination, cause the at least one display device to display an award for each displayed winning symbol combination;

(e) responsive to at least one wild symbol modification condition being satisfied based on at least two wild symbols being displayed at at least two of the symbol display positions and at least one non-wild symbol being displayed at at least one symbol display position related to at least one of the at least two symbol display positions which display the at least two wild symbols:

(i) modify the at least one non-wild symbol into a wild symbol, and (ii) repeat (c) to (e) until no wild symbol modification condition is satisfied, wherein each wild symbol modification condition is satisfied based on at least two wild symbols being displayed at at least two of the symbol display positions and at least one non-wild symbol being displayed at at least one symbol display position related to at least one of the at least two symbol display positions which display the at least two wild symbols, and (f) responsive to a cashout input being received via the cashout device, cause an initiation of any payout associated with the credit balance.

2. The gaming system of claim 1, wherein two of the symbol display positions are related if said symbol display positions are adjacent to each other.

3. The gaming system of claim 2, wherein the adjacent symbol display positions are each in the same symbol display position grid.

4. The gaming system of claim 1, wherein two of the symbol display positions are related if one of: (i) said symbol display positions are adjacent to each other, and (ii) said symbol display positions are not adjacent to each other.

5. The gaming system of claim 1, wherein at least one of any award for any displayed winning symbol combination is at least one of: a quantity of monetary credits, a quantity of non-monetary credits, a quantity of promotional credits, and a quantity of player tracking points.

6. A method of operating a gaming system, said method comprising:

(a) causing a display, by at least one display device, of one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(b) determining, by at least one processor, if any of the displayed symbols form any winning symbol combinations;

(c) responsive to a plurality of the displayed symbols forming at least one winning symbol combination, causing a display, by the at least one display device, of an award for each displayed winning symbol combination; and (d) responsive to at least one wild symbol modification condition being satisfied based on at least two wild symbols being displayed at at least two of the symbol display positions and at least one non-wild symbol being displayed at at least one symbol display position related to at least one of the at least two symbol display positions which display the at least two wild symbols:

(i) modifying, by the at least one processor, the at least one non-wild symbol into a wild symbol, and (ii) repeating (b) to (d) until no wild symbol modification condition is satisfied, wherein each wild symbol modification condition is satisfied based on at least two wild symbols being displayed at at least two of the symbol display positions and at least one non-wild symbol being displayed at at least one symbol display position related to at least one of the at least two symbol display positions which display the at least two wild symbols.

7. The method of claim 6, wherein two of the symbol display positions are related if said symbol display positions are adjacent to each other.

8. The method of claim 7, wherein the adjacent symbol display positions are each in the same symbol display position grid.

9. The method of claim 6, wherein two of the symbol display positions are related if one of: (i) said symbol display positions are adjacent to each other, and (ii) said symbol display positions are not adjacent to each other.

10. The method of claim 6, wherein at least one of any award for any displayed winning symbol combination is at least one of: a quantity of monetary credits, a quantity of non-monetary credits, a quantity of promotional credits, and a quantity of player tracking points.

11. The method of claim 6, which is provided through a data network.

12. The method of claim 11, wherein the data network is an internet.

13. A gaming system comprising:

at least one processor; and at least one memory device which stores a plurality of instructions, which when executed by the at least one processor, causes the at least one processor to:

(a) cause a display, by at least one display device, of one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(b) determine if any of the displayed symbols form any winning symbol combinations;

(c) responsive to a plurality of the displayed symbols forming at least one winning symbol combination, cause a display, by the at least one display device, of an award for each displayed winning symbol combination; and (d) responsive to at least one wild symbol modification condition being satisfied based on at least two wild symbols being displayed at at least two of the symbol display positions and at least one non-wild symbol being displayed at at least one symbol display position related to at least one of the at least two symbol display positions which display the at least two wild symbols:

(i) modify the at least one non-wild symbol into a wild symbol, and (ii) repeat (b) to (d) until no wild symbol modification condition is satisfied, wherein each wild symbol modification condition is satisfied based on at least two wild symbols being displayed at at least two of the symbol display positions and at least one non-wild symbol being displayed at at least one symbol display position related to at least one of the at least two symbol display positions which display the at least two wild symbols.

14. The gaming system of claim 13, wherein two of the symbol display positions are related if said symbol display positions are adjacent to each other.

15. The gaming system of claim 14, wherein the adjacent symbol display positions are each in the same symbol display position grid.

16. The gaming system of claim 13, wherein two of the symbol display positions are related if one of: (i) said symbol display positions are adjacent to each other, and (ii) said symbol display positions are not adjacent to each other.

17. The gaming system of claim 13, wherein at least one of any award for any displayed winning symbol combination is at least one of: a quantity of monetary credits, a quantity of non-monetary credits, a quantity of promotional credits, and a quantity of player tracking points.

18. The gaming system of claim 13, which transmits and receives data over a data network.

19. The gaming system of claim 18, wherein the data network is an internet.

20. A gaming system comprising:

a housing;

a plurality of input devices supported by the housing, said plurality of input devices including an acceptor, and a cashout device;

at least one display device supported by the housing;

at least one processor; and at least one memory device which stores a plurality of instructions, which when executed by the at least one processor, causes the at least one processor to:

(a) responsive to a physical item being received via the acceptor, establish a credit balance based, at least in part, on a monetary value associated with the received physical item, (b) cause the at least one display device to display one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(c) determine if any of the displayed symbols form any winning symbol combinations;

(d) responsive to a plurality of the displayed symbols forming at least one winning symbol combination, cause the at least one display device to display an award for each displayed winning symbol combination;

(e) responsive to at least one wild symbol modification condition being satisfied based on at least two wild symbols being displayed at at least two of the symbol display positions:

(i) modify at least one non-wild symbol into a wild symbol, wherein the non-wild symbol was displayed at at least one symbol display position related to at least one of the at least two symbol display positions which display the at least two wild symbols, two of the symbol display positions are related if one of: (A) said symbol display positions are adjacent to each other, and (B) said symbol display positions are not adjacent to each other, and the one of (A) the adjacent symbol display positions and (B) the non-adjacent symbol display positions are each in the same symbol display position grid, and (ii) repeat (c) to (e) at least once, wherein each wild symbol modification condition is satisfied based on at least two wild symbols being displayed at at least two of the symbol display positions, and (f) responsive to a cashout input being received via the cashout device, cause an initiation of any payout associated with the credit balance.

21. A method of operating a gaming system, said method comprising:

(a) causing a display, by at least one display device, of one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(b) determining, by at least one processor, if any of the displayed symbols form any winning symbol combinations;

(c) responsive to a plurality of the displayed symbols forming at least one winning symbol combination, causing a display, by the at least one display device, of an award for each displayed winning symbol combination; and (d) responsive to at least one wild symbol modification condition being satisfied based on at least two wild symbols being displayed at at least two of the symbol display positions:

(i) causing modifying, by the at least one processor, at least one non-wild symbol into a wild symbol, wherein the non-wild symbol was displayed at at least one symbol display position related to at least one of the at least two symbol display positions which display the at least two wild symbols, two of the symbol display positions are related if one of: (A) said symbol display positions are adjacent to each other, and (B) said symbol display positions are not adjacent to each other, and the one of (A) the adjacent symbol display positions and (B) the non-adjacent symbol display positions are each in the same symbol display position grid, and (ii) repeating (b) to (d) at least once, wherein each wild symbol modification condition is satisfied based on at least two wild symbols being displayed at at least two of the symbol display positions.

22. A gaming system comprising:

at least one processor; and at least one memory device which stores a plurality of instructions, which when executed by the at least one processor, causes the at least one processor to:

(a) cause a display, by at least one display device, of one of a plurality of different symbols at each of a plurality of symbol display positions of each of a plurality of symbol display position grids, wherein:

(i) the plurality of different symbols include a plurality of wild symbols, (ii) each symbol display position grid is associated with a different depth, and (iii) a plurality of the symbol display positions of a first one of the symbol display position grids associated with a first depth correspond to a plurality of the symbol display positions of a second one of the symbol display position grids associated with a second, different depth;

(b) determine if any of the displayed symbols form any winning symbol combinations;

(c) responsive to a plurality of the displayed symbols forming at least one winning symbol combination, cause a display, by the at least one display device, of an award for each displayed winning symbol combination; and (d) responsive to at least one wild symbol modification condition being satisfied based on at least two wild symbols being displayed at at least two of the symbol display positions:

(i) modify at least one non-wild symbol into a wild symbol, wherein the non-wild symbol was displayed at at least one symbol display position related to at least one of the at least two symbol display positions which display the at least two wild symbols, two of the symbol display positions are related if one of: (A) said symbol display positions are adjacent to each other, and (B) said symbol display positions are not adjacent to each other, and the one of (A) the adjacent symbol display positions and (B) the non-adjacent symbol display positions are each in the same symbol display position grid, and (ii) repeat (b) to (d) at least once, wherein each wild symbol modification condition is satisfied based on at least two wild symbols being displayed at at least two of the symbol display positions.

23. The method of claim 6, wherein any displayed award for any displayed winning symbol combination causes an increase of a credit balance which is increasable via an acceptor of a physical item associated with a monetary value, and decreasable via a cashout device.

24. The method of claim 6, wherein the at least one display device comprises a display device of a mobile device.

25. The method of claim 24, wherein the mobile device comprises a cellular mobile device.

26. The gaming system of claim 13, which comprises an acceptor, wherein when executed by the at least one processor, the plurality of instructions cause the at least one processor to, responsive to a physical item being received via the acceptor, establish a credit balance based, at least in part, on a monetary value associated with the received physical item, and responsive to a cashout input being received, cause an initiation of any payout associated with the credit balance.

27. The gaming system of claim 13, wherein the at least one display device comprises a display device of a mobile device.

28. The gaming system of claim 27, wherein the mobile device comprises a cellular mobile device.

29. The method of claim 21, wherein any displayed award for any displayed winning symbol combination causes an increase of a credit balance which is increasable via an acceptor of a physical item associated with a monetary value, and decreasable via a cashout device.

30. The method of claim 21, wherein the at least one display device comprises a display device of a mobile device.

31. The method of claim 30, wherein the mobile device comprises a cellular mobile device.

32. The gaming system of claim 22, which comprises an acceptor, wherein when executed by the at least one processor, the plurality of instructions cause the at least one processor to, responsive to a physical item being received via the acceptor, establish a credit balance based, at least in part, on a monetary value associated with the received physical item, and responsive to a cashout input being received, cause an initiation of any payout associated with the credit balance.

33. The gaming system of claim 22, wherein the at least one display device comprises a display device of a mobile device.

34. The gaming system of claim 33, wherein the mobile device comprises a cellular mobile device.

* * * * *